US006688492B2

(12) United States Patent
Jaworski et al.

(10) Patent No.: US 6,688,492 B2
(45) Date of Patent: Feb. 10, 2004

(54) DISPENSING VALVE

(75) Inventors: Thomas Jaworski, Racine County, WI (US); Donald J. Shanklin, Riverside County, CA (US); Nathan R. Westphal, Racine County, WI (US); David J. Houser, Racine County, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 10/056,873

(22) Filed: Jan. 24, 2002

(65) Prior Publication Data

US 2003/0136796 A1 Jul. 24, 2003

(51) Int. Cl.[7] ..... G01F 11/00

(52) U.S. Cl. ..... 222/1; 222/645; 222/649; 222/402.13; 222/402.2

(58) Field of Search ..... 222/1, 644, 645, 222/649, 402.11, 402.13, 402.18, 402.2

(56) References Cited

U.S. PATENT DOCUMENTS

| | | | | |
|---|---|---|---|---|
| 3,305,134 A | | 2/1967 | Carmichael, et al. | |
| 3,419,189 A | * | 12/1968 | Iketani | 222/54 |
| 3,477,613 A | | 11/1969 | Mangel | |
| 3,497,108 A | | 2/1970 | Mason | 222/61 |
| 3,542,248 A | | 11/1970 | Mangel | 222/70 |
| 3,658,209 A | | 4/1972 | Freeman et al. | |
| 3,664,548 A | | 5/1972 | Broderick | |
| 4,077,542 A | | 3/1978 | Petterson | |
| 4,396,152 A | | 8/1983 | Abplanalp | |
| 5,018,963 A | | 5/1991 | Diederich | |
| 5,025,962 A | * | 6/1991 | Renfro | 222/649 |
| 5,337,929 A | * | 8/1994 | van der Heijden | 222/402.18 |
| 5,702,036 A | * | 12/1997 | Ferrara, Jr. | 222/402.13 |
| 5,791,524 A | * | 8/1998 | Demarest | 222/153.06 |
| 6,216,925 B1 | | 4/2001 | Garon | 222/645 |

FOREIGN PATENT DOCUMENTS

| | | |
|---|---|---|
| EP | 826608 A1 | 3/1998 |
| JP | 57 174173 | 10/1982 |
| JP | 3-85170 | 4/1991 |
| JP | 03 085169 | 4/1991 |
| JP | 10216577 | 8/1998 |
| JP | 2001048254 | 2/2001 |

OTHER PUBLICATIONS

Patent Abstracts of Japan vol. 015, No. 256 (C–0845), Jun. 28, 1991 & JP 03 085170 A (Showa Seiki KK), Apr. 10, 1991 abstract—Spray Amount Control Mechanism of Automatic Jet Apparatus.

* cited by examiner

*Primary Examiner*—Joseph A. Kaufman

(57) ABSTRACT

A valve assembly can automatically dispense aerosol content from an aerosol container at predetermined intervals without the use of electric power. A diaphragm at least partially defines an accumulation chamber that receives gas propellant from a portion of the can during an accumulation phase. Once the internal pressure of the accumulation chamber reaches a predetermined threshold, the diaphragm moves, carrying with it a seal so as to unseal an outlet channel, and thereby initiate a spray burst of the main active chemical. The diaphragm assumes its original position when the pressure within the accumulation chamber falls below a threshold pressure.

8 Claims, 19 Drawing Sheets

FIG. 9
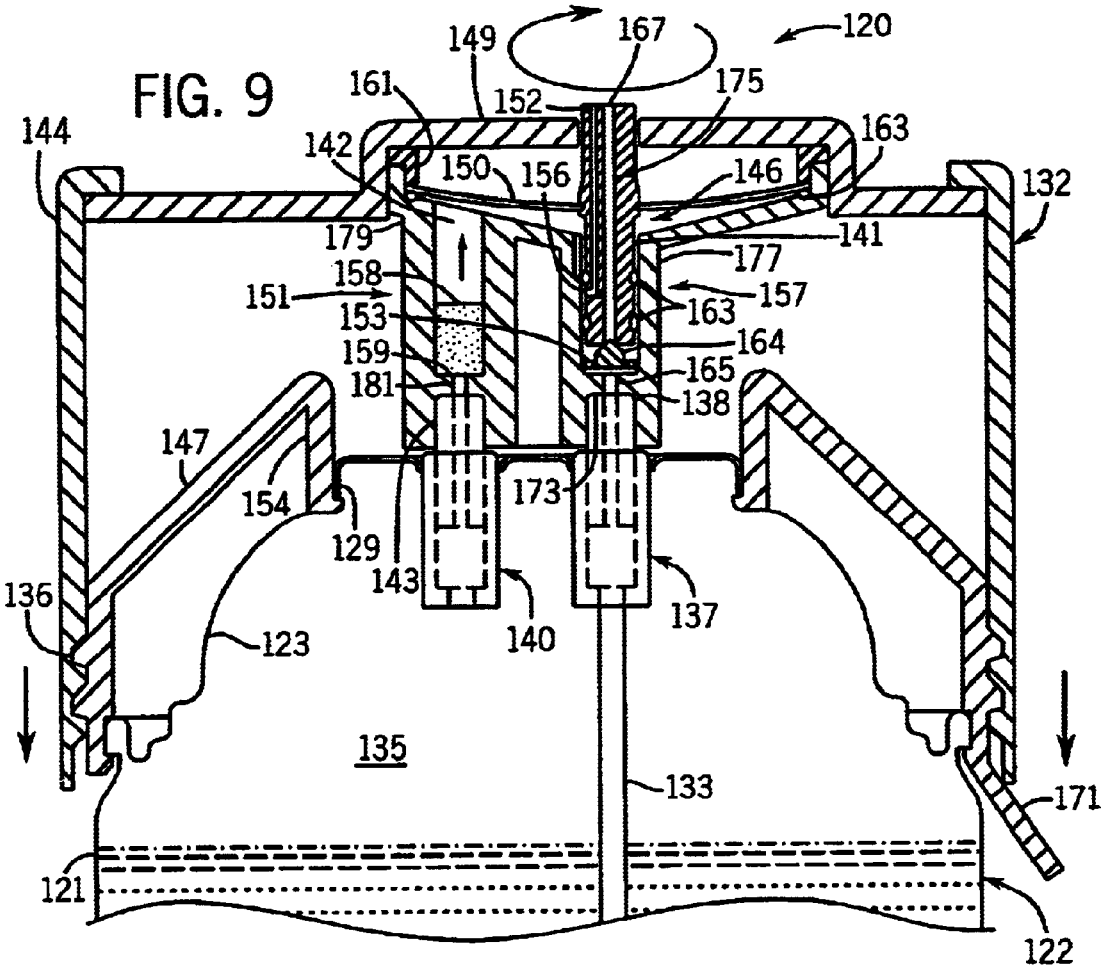
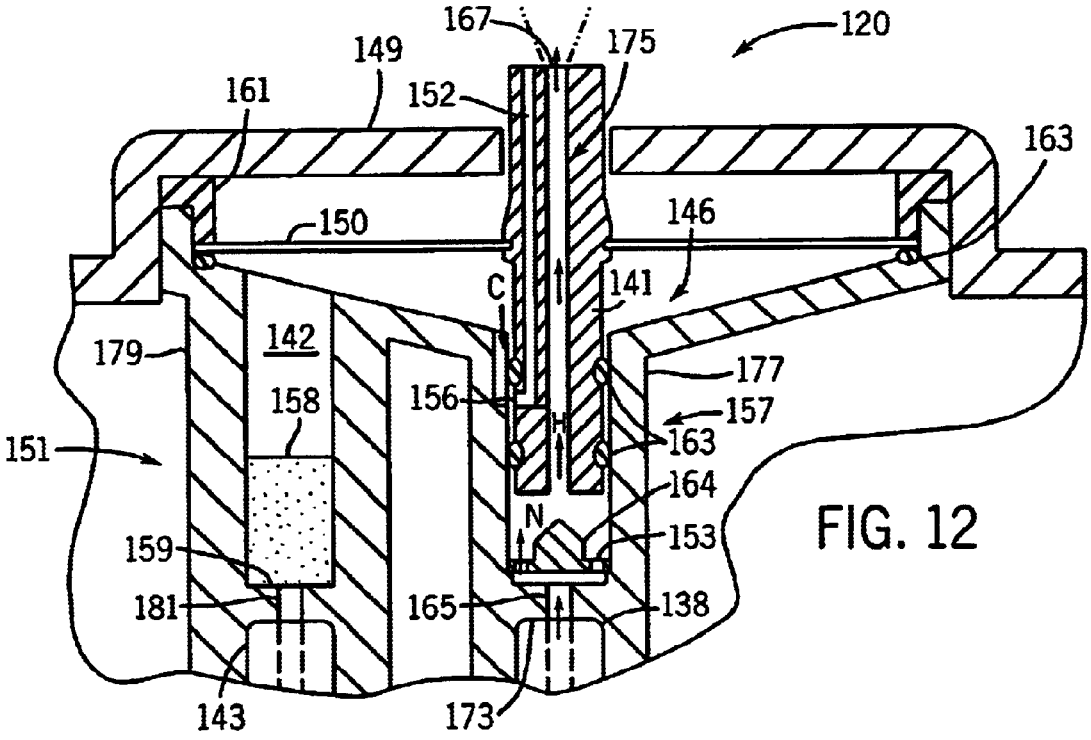
FIG. 12

220
261
249
267
275
250
246
279
256
241
244
258
263
232
251
257
265
264
242
238
247
273
253
224
237
229
236
227
254
225
234
239
223
259
271
235
233
221
222

249
267
220
261
275
250
246
279
241
244
256
232
258
263
257
251
264
265
242
238
247
273
253
237
224
229
236
227
254
225
234
239
223
259
271
235
233
221
222

DISPENSING VALVE

CROSS-REFERENCE TO RELATED APPLICATIONS

Not applicable

STATEMENT REGARDING FEDERALLY SPONSORED RESEARCH/DEVELOPMENT

Not applicable

BACKGROUND OF THE INVENTION

The present invention relates to aerosol dispensing devices, and in particular to valve assemblies that provide automatic dispensing of aerosol content at predetermined time intervals, without requiring the use of electrical power.

Aerosol cans dispense a variety of ingredients. Typically, an active is mixed with a propellant which inside the can is at least partially in a gas state, but may also be at least partially dissolved into a liquid containing active. Typical propellants are a propane/butane mix or carbon dioxide. The mixture is stored under pressure in the aerosol can. The active mixture is then sprayed by pushing down/sideways on an activator button at the top of the can that controls a release valve. For purposes of this application, the term "active chemical" is used to mean that portion of the content of the container (regardless of whether in emulsion state, single phase, or multiple phase), which is in liquid phase in the container (regardless of phase outside the container) and has a desired active such as an insect control agent (repellent or insecticide or growth regulator), fragrance, sanitizer, and/or deodorizer alone and/or mixed in a solvent, and/or mixed with a portion of the propellant.

Pressure on a valve control button is typically supplied by finger pressure. However, for fragrances, deodorizers, insecticides, and certain other actives which are sprayed directly into the air, it is sometimes desirable to periodically refresh the concentration of active in the air. While this can be done manually, there are situations where this is inconvenient. For example, when an insect repellant is being sprayed to protect a room overnight (instead of using a burnable mosquito coil), the consumer will not want to wake up in the middle of the night just to manually spray more repellant.

There a number of prior art systems for automatically distributing actives into the air at intermittent times. Most of these rely in some way on electrical power to activate or control the dispensing. Where electric power is required, the cost of the dispenser can be unnecessarily increased. Moreover, for some applications power requirements are so high that battery power is impractical. Where that is the case, the device can only be used where linkage to conventional power sources is possible.

Other systems discharge active intermittently and automatically from an aerosol can, without using electrical power. For example, U.S. Pat. No. 4,077,542 relies on a biased diaphragm to control bursts of aerosol gas at periodic intervals. See also U.S. Pat. Nos. 3,477,613 and 3,658,209. However, biased diaphragm systems have suffered from reliability problems (e.g. clogging, leakage, uneven delivery). Moreover, they sometimes do not securely attach to the aerosol can.

Moreover, the cost of some prior intermittent spray control systems makes it impractical to provide them as single use/throw away products. For some applications, consumers may prefer a completely disposable product.

However, many dispensing devices permit liquid with active to pass through a variety of narrow control passages in the valve. Over time, this can lead to clogging of the valve, and thus inconsistent operation. In U.S. Pat. No. 4,396,152 an aerosol dispensing system was proposed which separately accessed the vapor and liquid phases of the material in the container. However, this device did not achieve reliable automatic operation.

Thus, a need still exists for improved, inexpensive automated aerosol dispensers that do not require electrical power.

BRIEF SUMMARY OF THE INVENTION

In one aspect the invention provides a valve assembly that is suitable to dispense an active chemical from an aerosol container where the container has a first region holding a gas propellant and a second region holding an active chemical. The assembly is of the type that can automatically iterate between an accumulation phase where the gas is received from the container, and a spray phase where the active chemical is automatically dispensed at intervals. The regions need not be physically separated from each other. In fact, the preferred form is that the first region be an upper region of the can where propellant gas has collected above a liquid phase of the remainder of the can contents.

There is a housing mountable on an aerosol container. A movable diaphragm is associated with the housing and linked to a seal, the diaphragm being biased towards a first configuration. An accumulation chamber is inside the housing for providing variable pressure against the diaphragm. A first passageway in the housing is suitable for linking the first region of the aerosol container with the accumulation chamber, and a second passageway links the second region with an outlet of the valve assembly.

When the diaphragm is in the first configuration the seal can restrict the flow of active chemical out the valve assembly. When the pressure of chemical inside the accumulation chamber exceeds a specified threshold, the diaphragm can move to a second configuration where the active chemical is permitted to spray from the valve assembly.

In preferred forms a porous material is disposed within the first passageway to regulate the flow rate of gas propellant there through. The diaphragm shifts back to the first configuration from the second configuration when pressure of the gas propellant in the accumulation chamber falls below a threshold amount.

The accumulation chamber will exhaust the gas when the diaphragm is in the second configuration. The gas propellant and active chemical may mix in the valve assembly outside of the can. Alternatively and preferably, the active chemical and gas propellant may exit the dispenser as separate streams.

There may also be a container that is linked to the valve assembly, and an actuator portion of the housing that rotates to allow gas propellant to leave the container and enter the first passageway. The seal may be displaceable in an axial direction to allow gas propellant to flow through the first passageway into the accumulation chamber.

Methods for using these valve assemblies with aerosol containers are also disclosed.

The present invention achieves a secure mounting of a valve assembly on an aerosol can, yet provides an actuator that has two modes. In one mode the valve assembly is operationally disconnected from the actuator valve of the aerosol container (a mode suitable for shipment or long-term storage). Another mode operationally links the valve assembly to the aerosol container interior, and begins the cycle of periodic and automatic dispensing of chemical there from. Importantly, periodic operation is achieved without requiring the use of electrical power to motivate or control the valve.

The valve assembly has few parts, and is inexpensive to manufacture and assemble. Moreover the separate accessing of the gas propellant lets the gas (as distinguished from more viscous liquid) motivate the diaphragm and thus provides for cleaner and more reliable operation. By not requiring liquid and vapor to both pass through the porous media, there is much less likelihood for clogging due to extended use over months. Using the separation concepts described in this patent, product is released under full pressure with liquid propellant (as in a typical manually operated aerosol can), so as to provide for very effective particle break-up. If in a device like the present one the propellant gas was not separated from the main product, it might separate in the accumulation chamber or elsewhere in the device, thereby providing inconsistent results.

The foregoing and other advantages of the invention will appear from the following description. In the description reference is made to the accompanying drawings which form a part thereof, and in which there is shown by way of illustration, and not limitation, preferred embodiments of the invention. Such embodiments do not necessarily represent the full scope of the invention, and reference should therefore be made to the claims herein for interpreting the scope of the invention.

BRIEF DESCRIPTION OF THE DRAWINGS

FIG. 9 is a sectional view of an automatic dispensing valve assembly of another embodiment in an "off" configuration;

FIG. 12 is a view similar to FIG. 11, but with the valve in the spray phase of the dispensing cycle;

DETAILED DESCRIPTION OF THE PREFERRED EMBODIMENT

Figure 1:
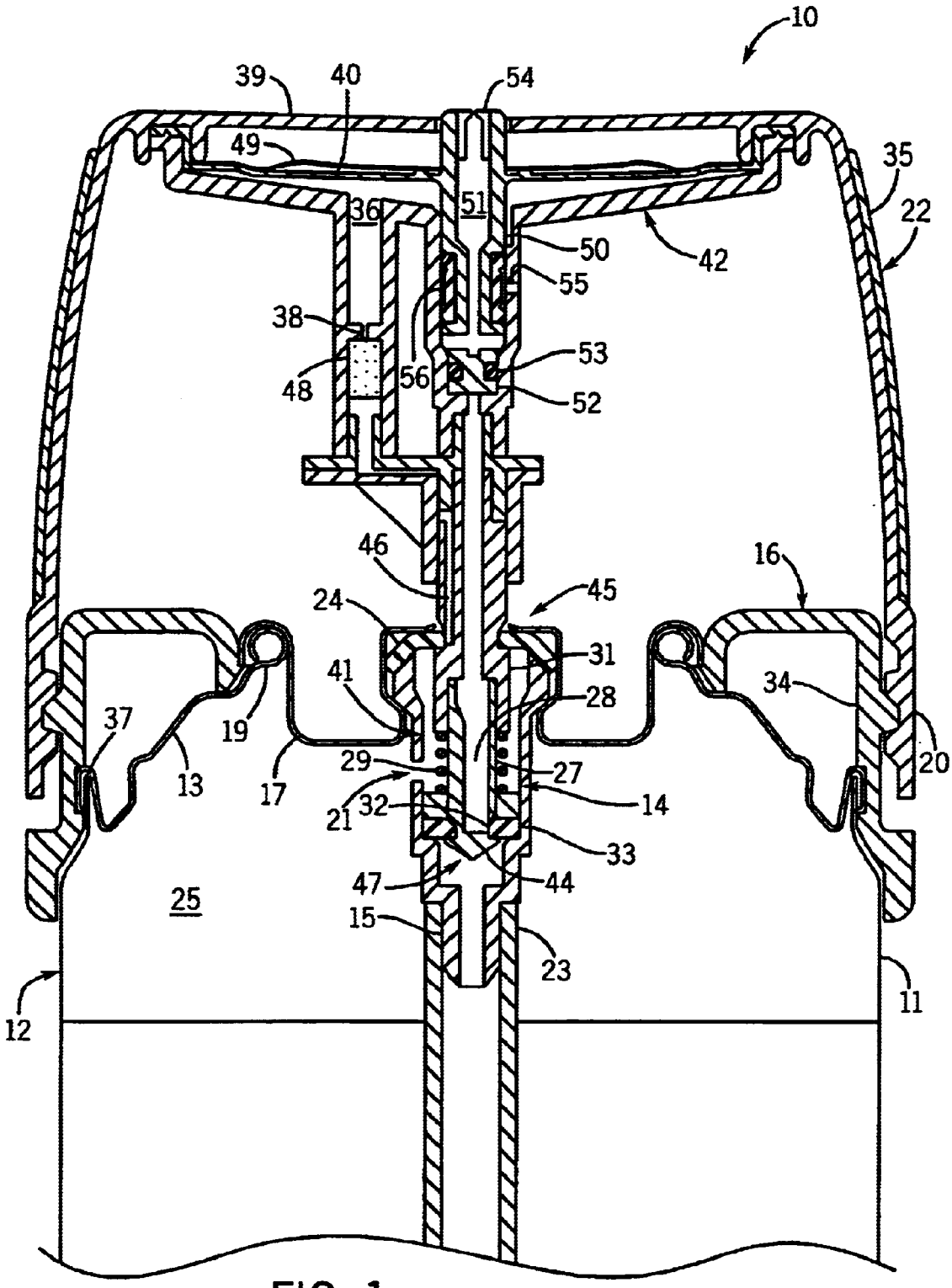
FIG. 1 is a schematic sectional view of a first preferred automated dispensing valve assembly of the present invention in an off configuration, mounted on an aerosol can.

Referring initially to FIG. 1, an aerosol can 12 includes a cylindrical wall 11 that is closed at its upper margin by a dome 13. The upper margin of the can wall 11 is joined at a can chime 37. An upwardly open cup 17 is located at the center of the dome 13 and is joined to the dome by a rim 19.

The can 12 includes an axially extending conduit 23 that is centrally disposed therein, and opens into a mixed pressurized chemical (active and gas propellant) at one end (preferably towards the bottom of the can). The upper region 25 of the can interior above the active chemical line contains pressurized gas propellant. The lower region contains a mix of liquid gas and the active chemical. The upper end of conduit 23 receives a tee 15 that interfaces with the interior of dispenser 10, through which the chemical may be expelled.

Dispenser 10 includes a can valve assembly 45 that, in turn, includes a gas propellant valve assembly 41 and an active valve assembly 47. Dispenser 10 permits aerosol content to be automatically expelled into the ambient environment at predetermined intervals, as will be described in more detail below. Dispenser 10 is mostly polypropylene, albeit other suitable materials can be used.

A mounting structure 16 is snap-fit to the valve cup rim 19 at its radially inner end, and to the can chime 37 at its radially outer end. The radially outer wall 34 of mounting structure 16 extends axially, and is threaded at its radially outer surface. The dispenser 10 has a radially outer wall 35 that includes a lower skirt portion 20 which forms part of a control assembly 22. Skirt 20 has threads disposed on its radially inner surface that intermesh with threads on outer wall 34 to rotatably connect the dispenser 10 to the aerosol can 12. The axially outer end of wall 35 terminates at a radially extending cover having a centrally disposed outlet that contains a dispensing nozzle 54 which enables active to be sprayed out the dispenser 10 at predetermined intervals, as will be described in more detail below. In operation, the dispenser 10 may be switched "ON" and "OFF" by rotating member 22 relative to the can 12, as will be apparent from the description below.

It should be appreciated that throughout this description, the terms "axially outer, axially downstream, axially inner, axially upstream" are used with reference to the longitudinal axis of the container. The term "radial" refers to a direction outward or inward from that axis.

Figure 2:
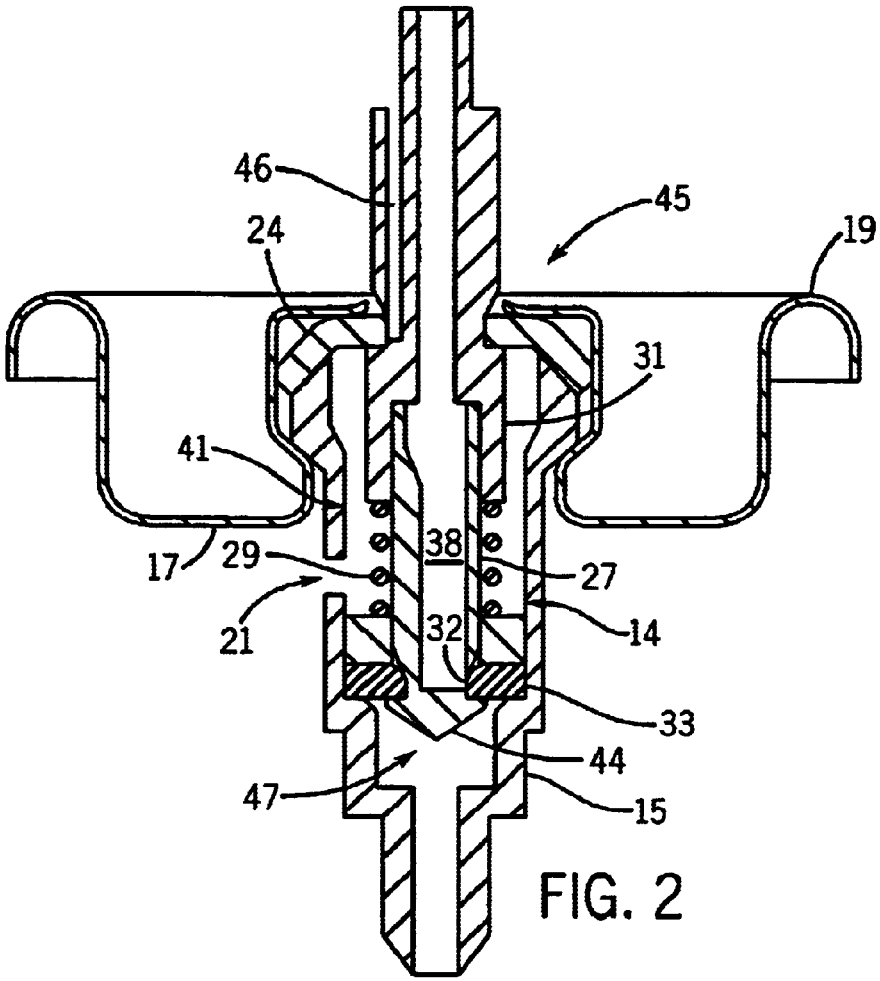
FIG. 2 is an enlarged view of the can valve portion of the dispensing valve assembly of FIG. 1.

Referring also to FIG. 2, the tee 15 defines an interior cavity 14 disposed axially downstream from conduit 23. Tee 15 is sized so as be to crimped within the center of the open end of cup 17. An elongated annular wall 27 defines a first conduit 28 that extends axially from the interior of cavity 14 and centrally through the dispenser 10 to deliver the active mixture from the can 12 the dispensing nozzle 54. An elongated valve stem 31 extends axially downstream from wall 27 into the dispenser 10, and thus enables conduit 28 to extend into the dispenser.

Tee 15 further defines a passageway 21 extending between cavity 14 and gaseous collection portion 25. Passageway provides a propellant intake channel, as will become more apparent from the description below. A propellant delivery channel 46 extends axially through conduit 31, and connects cavity 14 with an accumulation chamber 36 that receives propellant. As will be described in more detail below, the internal pressure of accumulation chamber 36 determines whether the dispenser 10 is in a spray phase or an accumulation phase.

Valve stem 31 exerts pressure against gasket 33 via a spring member 29. Wall 27 provides a plunger that extends axially upstream from the axially inner end of valve stem 31, and terminates at a seal 44 that is biased against the gasket 33. When the dispenser is "OFF," (See FIG. 2) the spring force biases seal 44 against the gasket 33, thereby preventing active from flowing into channel 28. Furthermore, valve stem 31 is biased against a gasket 24 proximal the outer end of can 12 to provide a seal there between, thus preventing the flow of propellant from can 12 into passageway 46. Accordingly, neither gas propellant nor active mixture is permitted to flow from the can 12 into the dispenser at this time. The dispenser 10 is thus in a storage/shipment position.

A channel 32 extends through the surface of wall 27 proximal the seal 44 to enable the active to flow into the dispenser 10 when the dispenser is in an "ON" configuration, as will be described in more detail below.

Figure 3:
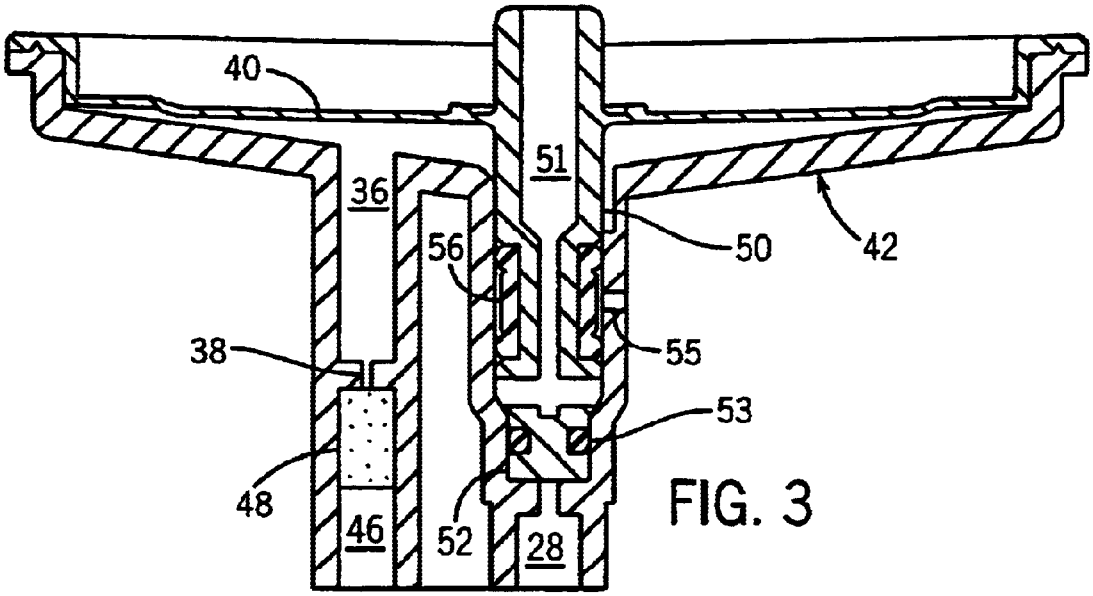
FIG. 3 is an enlarged view of the dispensing portion of the dispensing valve assembly of FIG. 1.

Referring now also to FIG. 3, the axially outer end of valve stem 31 terminates at a centrally disposed inlet to a retainer wall 42 that, in turn, connects to an axially extending annular conduit 50. Conduit 50 extends outwardly to nozzle 54, and provides an outlet channel 51 to deliver active to the ambient environment. A plug 52 is disposed at the inner end of channel 51, and is sealed by an o-ring 53 to prevent pressurized active from flowing out the dispenser 10 when the dispenser is not in a "SPRAY" phase, as will be described in more detail below.

Conduit 46 extends radially outwardly proximal the junction between conduits 50 and 31, and opens at its axially outer end into a propellant inlet 38 of retainer wall 42. An accumulation chamber 36 is defined by a retainer wall 42 that, in combination with a flexible, mono-stable diaphragm 40, encases the accumulation chamber 36. Diaphragm 40 comprises an annular plate that is supported at its outer surface by an annular spring member 49 that biases the diaphragm 40 towards the closed position illustrated in FIG. 1.

The diaphragm 40 is movable between the first closed position (FIG. 4) and a second open position (FIG. 5) to activate the dispenser 10 at predetermined intervals, as will be described in more detail below. A porous media 48, which is preferably made of a low porosity ceramic or any other similarly permeable material, is disposed in inlet 38 to accumulation chamber 36 to regulate the flow rate of entering gas propellant. The radially outer edge of diaphragm 40 extends into a groove formed on the radially inner surface of cover 39 at its axially outer end. The radially inner edge of diaphragm is integrally connected to conduit 50.

Conduit further includes a propellant vent 55 extending through its outer wall that enables propellant to escape during the spray phase, as will be described in more detail below. The vent 55 is sealed by an elongated sleeve 56 that prevents the escape of propellant during the accumulation phase.

Figure 4:
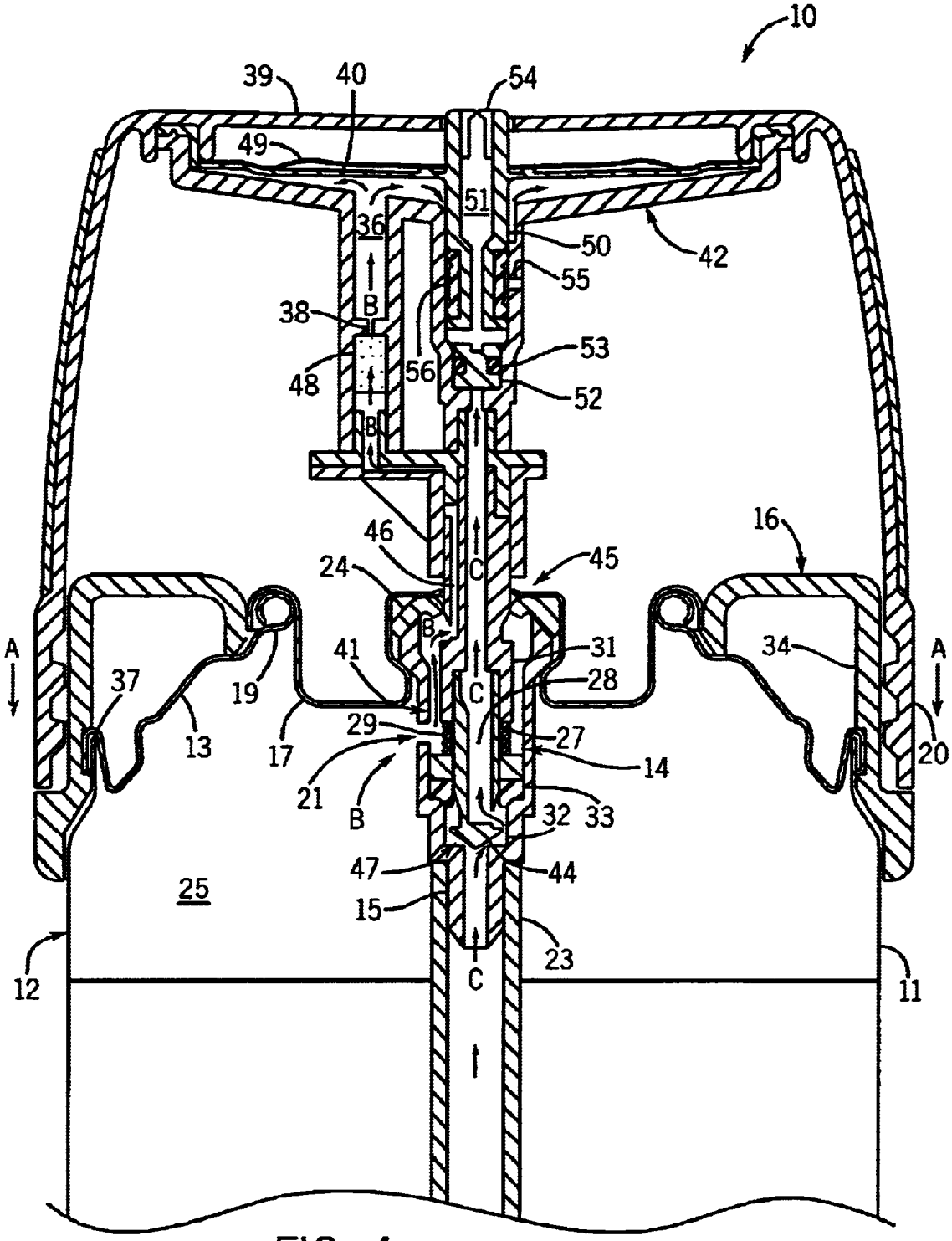
FIG. 4 is a view similar to FIG. 1, with the device shown in the on configuration during an accumulation phase.
Figure 5:
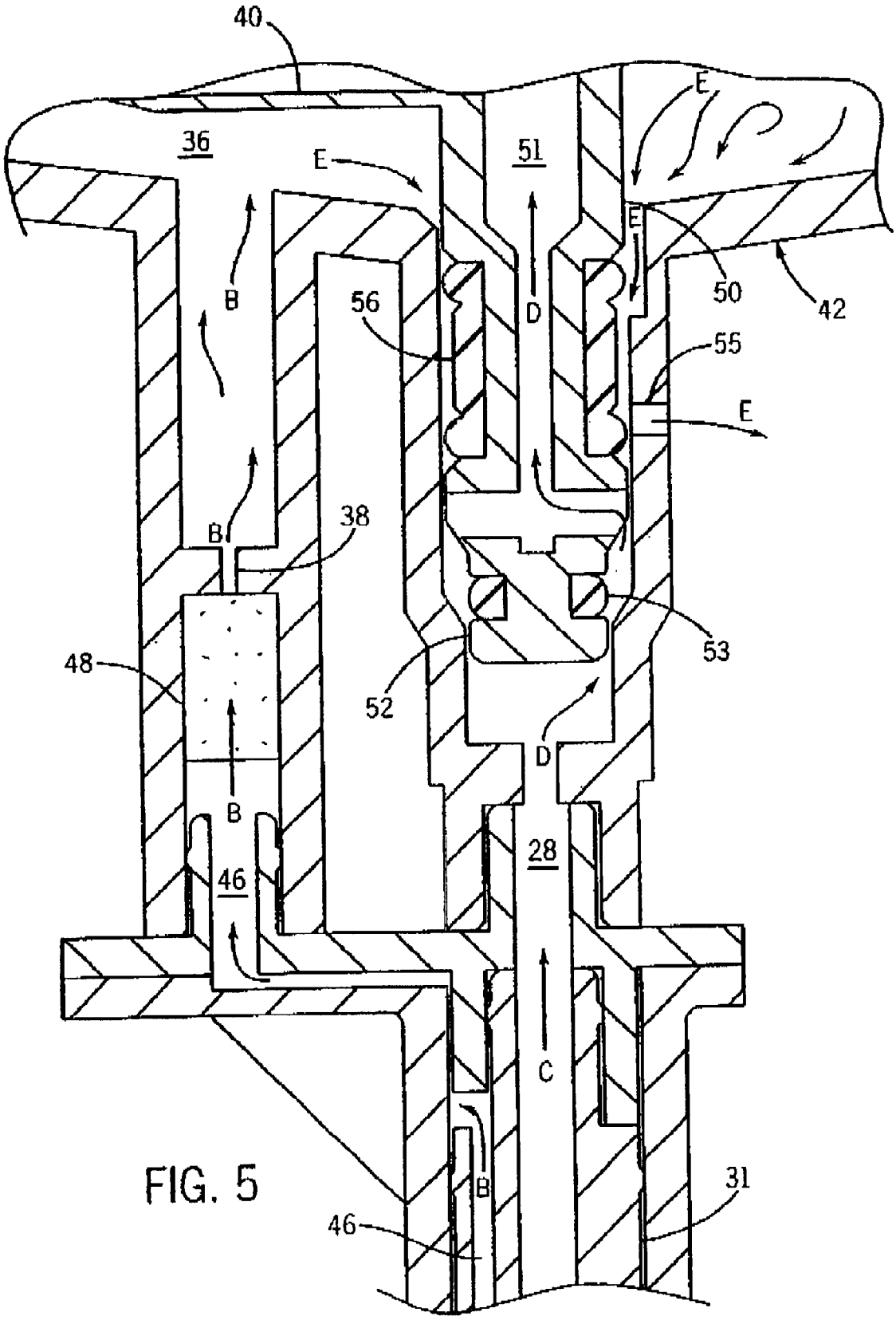
FIG. 5 is an enlarged view of a portion of the FIG. 1 device, but with the device shown in a spray phase.

Referring now to FIG. 4, the dispenser is turned "ON" by rotating the control assembly 22 is rotated to displace the dispenser 10 axially inwardly along the direction of arrow A. It should be appreciated that the compliance of spring 29 minimizes the risk of damage to the dispenser 10 due to over-rotation by the user. Also, there is a shoulder feature on the element 16 to act as an additional stop. The valve stem 31 is displaced downward, thereby compressing spring 29 to displace the seal 44 axially upstream and away from gasket 33. The displacement of valve stem 31 furthermore removes the seal 24.

An accumulation phase is thereby initiated, in which the pressurized gas propellant flows from the can 12 downstream along the direction of arrow B through cavity 14 and into channel 46. The propellant then travels into the inlet 38 of accumulation chamber 36, where it is regulated by porous flow control media 42 before flowing into the accumulation chamber.

Once the control assembly 22 has been rotated to turn the dispenser 10 "ON," pressurized active mixture is also able to exit the can 12. In particular, the active flows through conduit 23, and around the seal 44 into channel 21, where it continues to travel along the direction of Arrow C towards outlet channel 51. However, because plug 52 is disposed at the mouth of channel 51, the active is unable to travel any further during downstream.

During the accumulation phase, the constant supply of gas propellant flowing from intake channel 46 into the accumulation chamber 36 causes pressure to build therein, and such pressure acts against the inner surface of diaphragm 40. Once the accumulation chamber 36 is sufficiently charged with gas propellant, such that the pressure reaches a predetermined threshold, the mono-stable diaphragm 40 becomes deformed from the normal closed position illustrated in FIG. 4 to the open position illustrated in FIG. 5.

This initiates a spray phase, during which the diaphragm 40 causes conduit 50 to become displaced axially outwardly. As conduit 50 becomes displaced outwardly, plug 52 becomes removed from channel 28. Accordingly, because the inner diameter of retainer wall 42 increases as plug 52 travels downstream, the active mixture is permitted to travel from conduit 28, around the plug, and into outlet channel 51 along the direction of Arrow D. The pressurized active then travels from channel 51 and out the nozzle 54 as a spray. It should be appreciated that the seal between the inner end of sleeve 56 and the inner surface of retainer wall 42 upstream of propellant vent 55 is maintained during the spray phase, thereby preventing the active mixture from exiting the dispenser through the vent 55.

The displacement of wall 50 further removes the outer seal of sleeve 56 from the inner surface of retainer wall 42, thus enabling the pressurized gas propellant that was stored in the accumulation chamber 36 during the previous accumulation cycle, along with gas propellant entering into accumulation chamber 36 during the spray phase, to exit the accumulation chamber via vent 55 along the direction of Arrow E. Because the outer wall 35 is not air tight, propellant is able to exit the dispenser 20 from vent 55. Because more gas propellant exits accumulation chamber 36 than propellant that enters via flow control media 48, the pressure within the accumulation chamber quickly abates during the spray phase.

Once the pressure within chamber 36 falls below a predetermined threshold, the diaphragm 40 snaps back to its normal closed position, re-establishing the seal formed by plug 52 with respect to channel 28. Accordingly, active mixture is once again prevented from exiting the dispenser, while gas propellant continues to flow into the accumulation chamber 36 in the manner described above to initiate the next spray phase. The cycle is automatic and continuously periodic until the propellant is exhausted.

It should be appreciated that the dispenser 10 and can 12 may be sold to an end user as a pre-assembled unit. In operation, the user rotates the assembly 22 to displace the valve assembly 45 axially inwardly, thereby causing the aerosol contents to flow out of can 12, and beginning the accumulation cycle. The gas propellant flows through conduit 46 and into the accumulation chamber 36. Once the spray phase is initiated, the active mixture flows through conduit 51, and exits the nozzle 54 as a "puff" into the ambient environment. Advantageously, because no active chemical enters the accumulation chamber 36, liquid "pooling" within the accumulation chamber is prevented, and any tendency of the active to clog passageways associated therewith is avoided.

The duration of the accumulation phase may be controlled, for example, by adjusting the stiffness of diaphragm 40, the internal volume of chamber 36, and/or the porosity of porous flow media 48. The duration of the spray phase may be controlled, for example, by modifying the clearance between the recessed portion 56 and inner wall 42, and the porosity of flow control media 48, thereby controlling the depressurization time of chamber 36. Other modifications can be made by modifying the diameter of the vent 55, changing spring pressure, or the addition of greater amounts of or different flow control media.

It should be appreciated that several different valve configurations are compatible with the present invention. For example, referring now to FIG. 6, a valve assembly 182 is disposed within a conventional can 183 as described above. Valve assembly 182 includes a conduit 184 that extends axially within the can 183 and delivers active mixture to the valve assembly. A tee 185 extends from the axially outer end of conduit 184. Tee defines an internal channel 186 that delivers active to an outer conduit 187.

Figure 7:
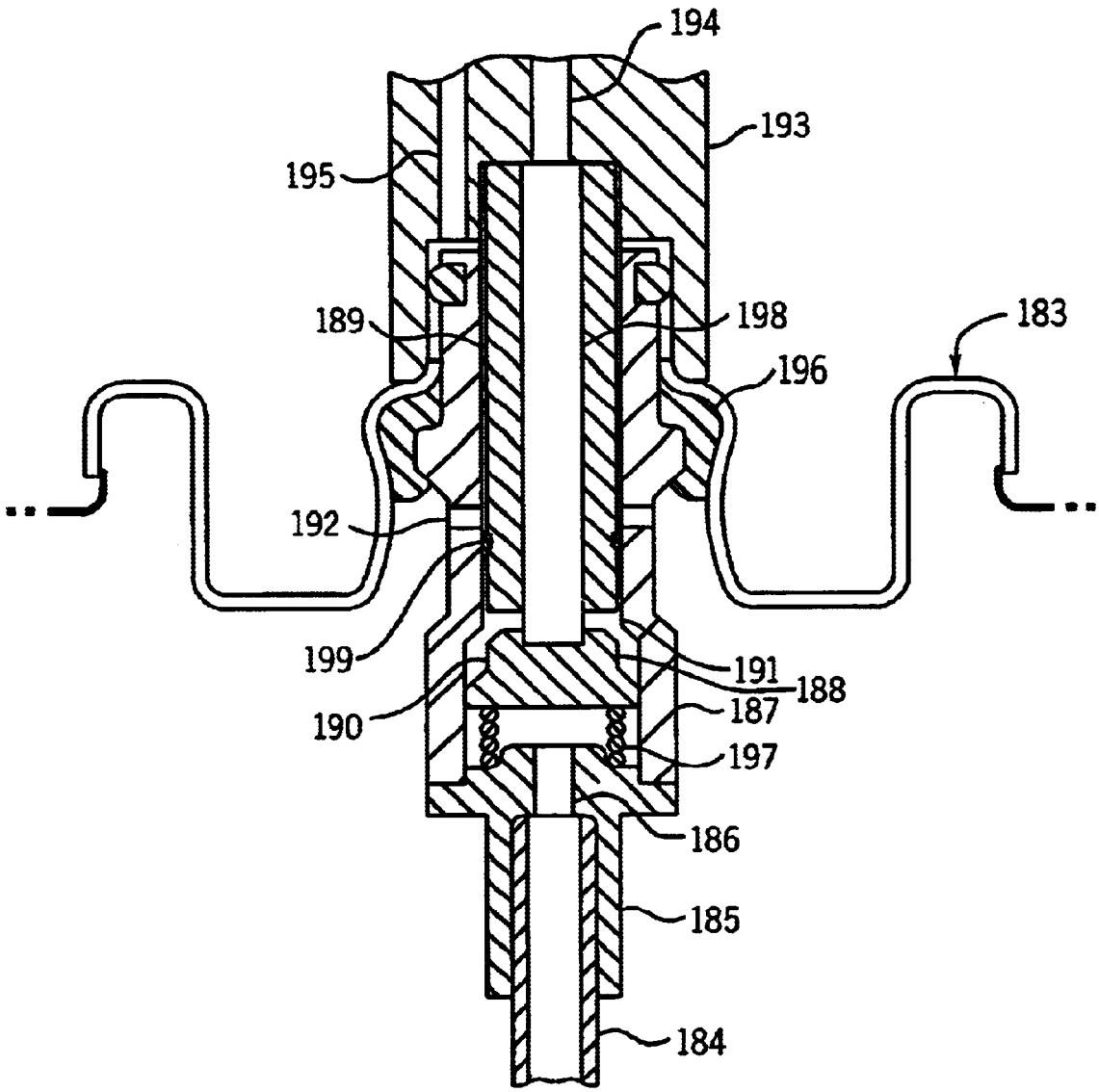
FIG. 7 is a view similar to FIG. 6, with the valve in the "on" configuration.

Outer conduit 187 receives an inner conduit 188 whose outer diameter is slightly less than the inner diameter of outer conduit 187 so that a gap 189 extends there between. Inner conduit 188 defines an axially extending channel 198 that can deliver the active mixture to the dispenser once the valve assembly has been turned on (See FIG. 7). In particular, an active intake channel 191 extends through inner conduit 188 that can deliver active from the interior of conduit 187 to channel 198.

Figure 6:
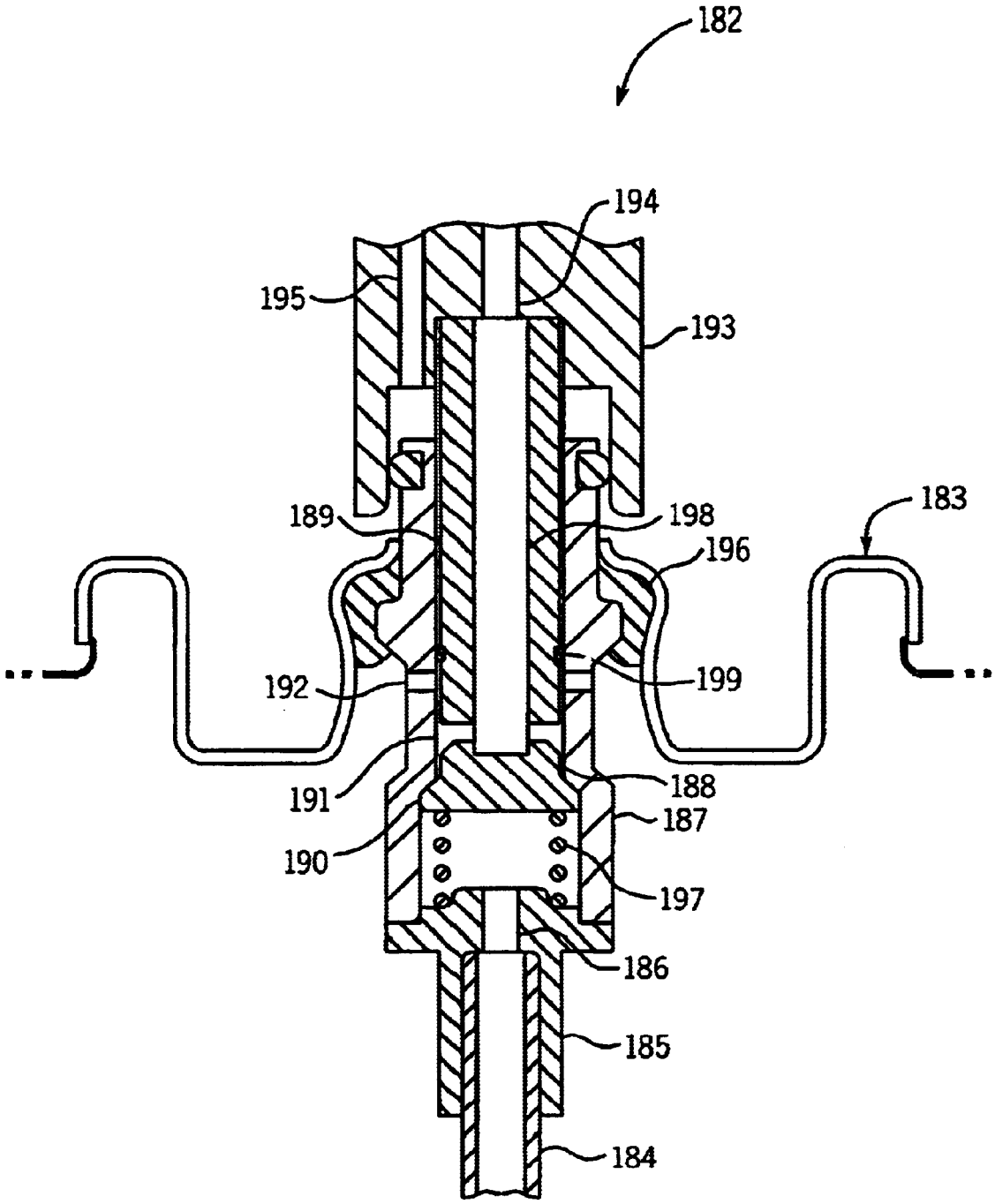
FIG. 6 is a sectional view of the valve portion of a can valve assembly of an alternate embodiment.

However, the base 190 of inner conduit 188 is sealed against the inner surface of outer conduit 187 to prevent active chemical from flowing into channel 198 when the dispenser is "off" as illustrated in FIG. 6. A spring member 197 connects the outer end of tee 185 to the inner end of base 190, and biases inner wall axially outwardly.

A propellant intake channel 192 extends through outer conduit 187, and connects the propellant region of can 183 with channel 189. An o-ring 199 is disposed between the outer surface of conduit 188 and the inner surface of conduit 187 at a location immediately downstream of channel 192 to prevent propellant from entering channel 189 when the valve assembly 182 is "off."

A housing 193 is connected to conduit 188 at its axially outer end, and defines an active delivery channel 194 that is aligned with channel 198, and a propellant delivery channel 195 that is aligned with channel 189.

Outer conduit 187 includes a flange that is embedded within a gasket 196 that is seated in the valve cup. The position of conduit 187 is thereby fixed when the control assembly (not shown) is rotated by a user to turn the valve assembly 182 "on." Accordingly, inner conduit 188 translates axially upstream with respect to outer conduit 187. Because the base 190 thus becomes removed from inner surface of tee 185, active mixture is able to flow through channel 191 and into axially extending channels 198 and 194 towards a retainer wall (not shown) as described above.

Furthermore, as the inner conduit 188 is displaced, o-ring 199 is also translated axially upstream of propellant intake channel 198. As a result, propellant enters channel 198 and travels along channels 189 and 195 towards an accumulation chamber (not shown) as described above. Accordingly, valve assembly 182 is suitable to deliver active mixture and propellant as separate streams to a dispenser having an accumulation chamber that operates as described above.

Figure 8A:
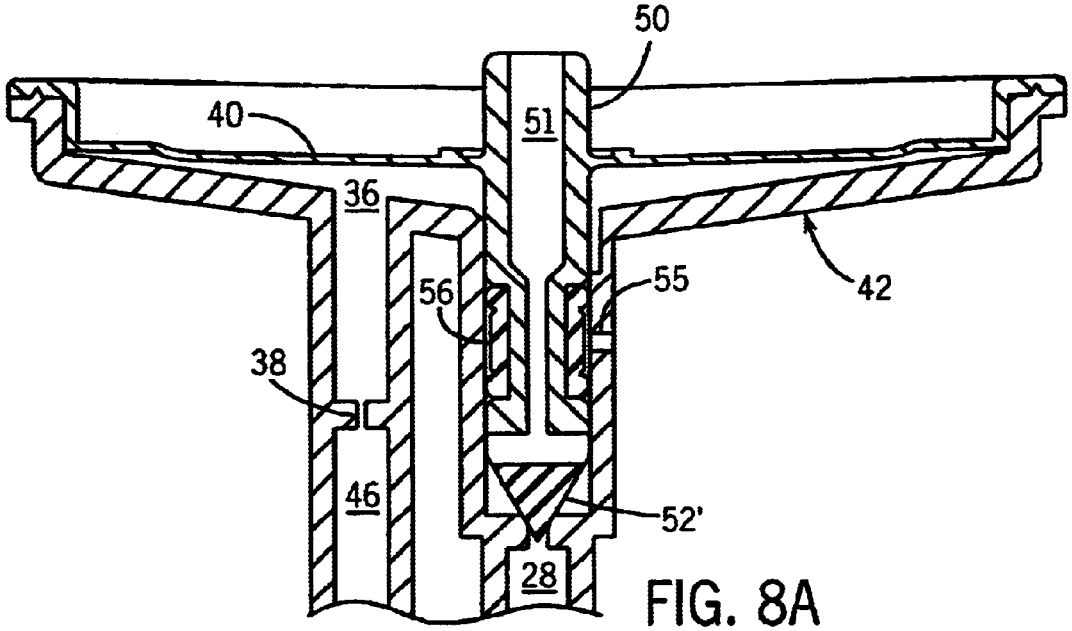
FIGS. 8A–D are views of alternative dispensing valve plugs usable with the present invention.
Figure 8B:
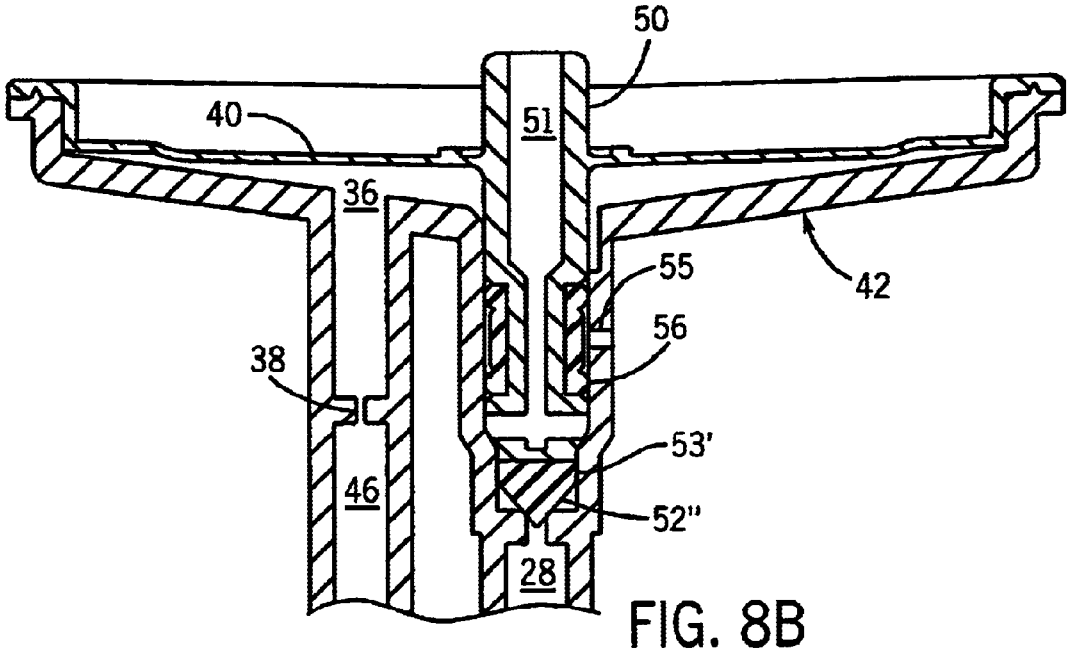

Referring now to FIGS. 8A–8D, it should be appreciated that several variations of plug 52 are available. For example, as illustrated in FIG. 8A, plug 52' presents a triangular face with respect to the flow of active mixture that provides a sufficiently tight seal with respect to the inlet to channel 51 without the need for an additional o-ring. Referring to FIG. 8B, it should be appreciated that an o-ring 53' could be added to the plug 52" to provide an additional seal between the plug and retainer wall 42. The sliding seal provided by plug 52 and o-ring 53' thus provides further assurance that any minimal active mixture that seeps past plug 52' will not travel into channel 51.

Figure 8C:
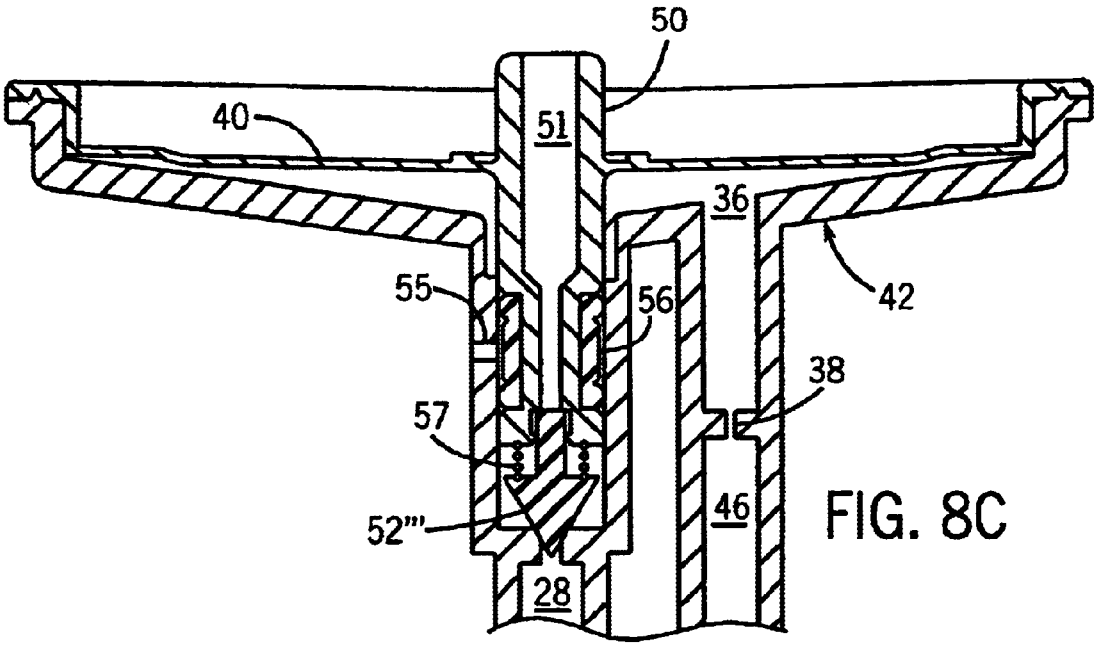
Figure 8D:
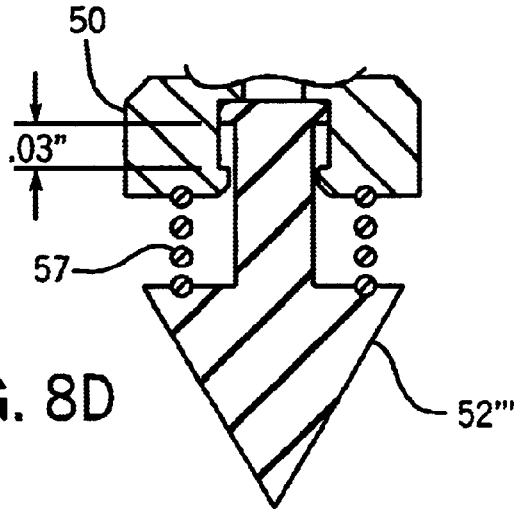

Referring to FIGS. 8C–8D, a plug 52'" is presented with in combination with a spring 57 that extends between the axially outer surface of the plug and the axially inner surface of conduit 50. In particular, the base of the plug 52'" is disposed within a slot 58 formed in the wall 50 that enables the plug to travel 0.03 inches in accordance with the preferred embodiment. The clearance provided in this embodiment enables the diaphragm to expand slightly prior to the active mixture flowing through outlet 51. The spring 57 provides additional compliance.

Referring next to FIG. 9, a dispenser 120 in accordance with another embodiment is mounted onto can 122 via outer wall 144 that has a threaded inner surface so as to intermesh with threads on the outer surface of wall 136. A cover 149 extends substantially radially inwardly from the axially outer end of wall 144. Wall 136 has a flange at its axially inner surface that engages can chime 139. Wall 136 is integrally connected to an angled wall 147 that extends radially inwardly, and axially downstream, there from. Wall 147 is integrally connected at its radially inner edge to wall 154 that extends axially upstream and has a flange that engages rim 129.

Control assembly 120 further includes a lever 171 that is rotated along with wall 144 to displace the control assembly 132 in the axial direction, as described above. Additionally, lever 171 could include a perforated tab (not shown) between itself and wall 144 that is broken before the dispenser can be actuated, thereby providing means for indicating whether the dispenser has been tampered with.

Can 122 includes first and second valves 137 and 140, respectively, that extend into can 122. Valve 137 is connected to a conduit 133 that extends axially towards the bottom of the can so as to receive the chemical mixture. Valve 140 terminates in the upper region 135 of can 122 so as to receive gaseous propellant. Valves 137 and 140 includes a downwardly actuatable conduit 138 and 143, respectively, that extend axially out of the can 122. Accordingly, dispenser 120 may be provided as a separate part that is mountable onto can 122 by rotating wall 144 with respect to wall 136.

Figure 11:
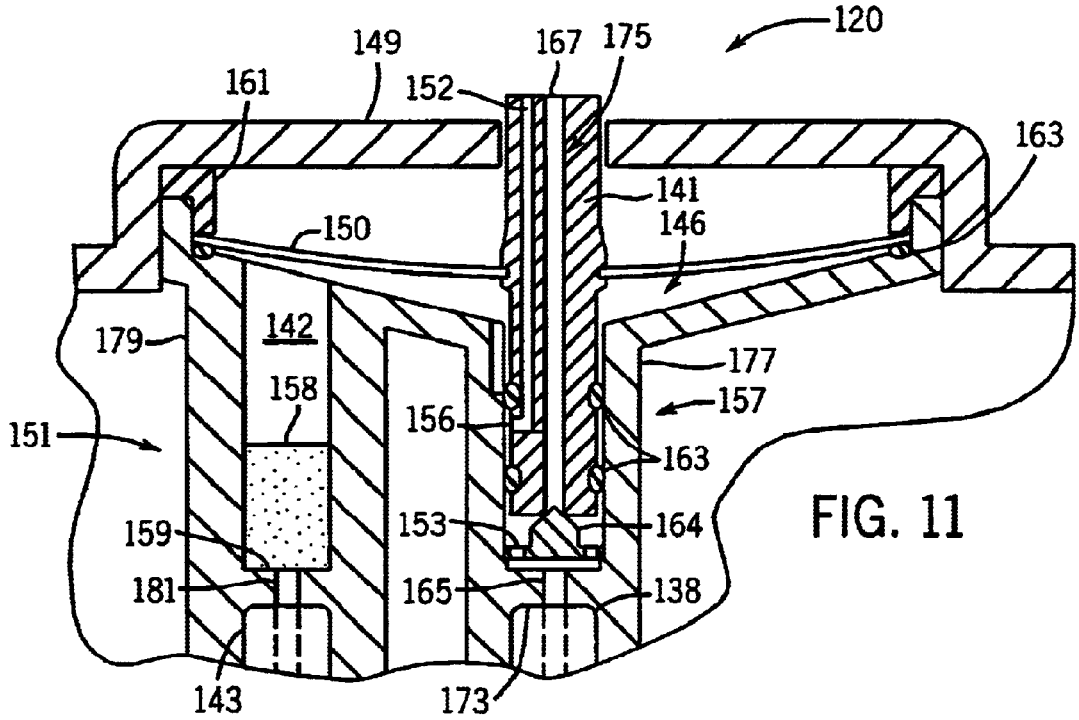
FIG. 11 is an enlarged view of a part of the valve assembly of FIG. 9.

Referring to FIG. 11, active valve assembly 157 includes an annular wall 177 whose axially inner end slides over conduit 137. A flange 173 extends radially inwardly from wall 177, and engages the outer end of conduit 138. Flange 173 defines a centrally disposed channel 165 that extends axially there through and aligned with conduit 138. An annular wall 141 fits inside wall 177 and extends axially downstream from flange 173, and defines an axially extending conduit 175 that is in fluid communication with channel 165. Channel 165 extends out the dispenser 120 to provide an outlet 167 to the ambient environment. Wall 141 further defines a second channel 152 that extends axially between a propellant outlet vent 156 and the ambient environment.

A plug 164 is disposed between channels 175 and 165, and blocks channel 165 so as to prevent the active chemical from exiting from the dispenser 120 when not in the spray phase. A pair of o-rings 163 are disposed between the inner surface of wall 177 and the outer surface of wall 141 to further ensure that no active chemical or propellant is able to exit dispenser 120 through vent 156 that extends through wall 141. An annular channel 153 surrounds plug 164 and joins channels 165 and 175 in fluid communication during the spray phase, as will be described in more detail below.

The propellant valve assembly 151 includes an annular wall 179 defining a conduit 142 that extends axially from valve stem 143 into an accumulation chamber 146. Accumulation chamber is defined by a diaphragm 150 that extends radially from a wall 161 that is disposed at the interface between cover 149 and the axially outer end of wall 179, axially inner portion of wall 161, inner surface of wall 179, and outer surface of wall 141. Diaphragm 150 is further connected at its radially inner end to wall 141.

Wall 179 includes a flange 159, similar to flange 173 of wall 177, that engages valve stem 143, and defines a channel 181 extending there through that joins valve stem 143 and conduit 142 in fluid communication. A porous flow control media 158 is disposed within channel 142 axially downstream from flange 159 so as to regulate the flow of propellant into accumulation chamber 146.

Figure 10:
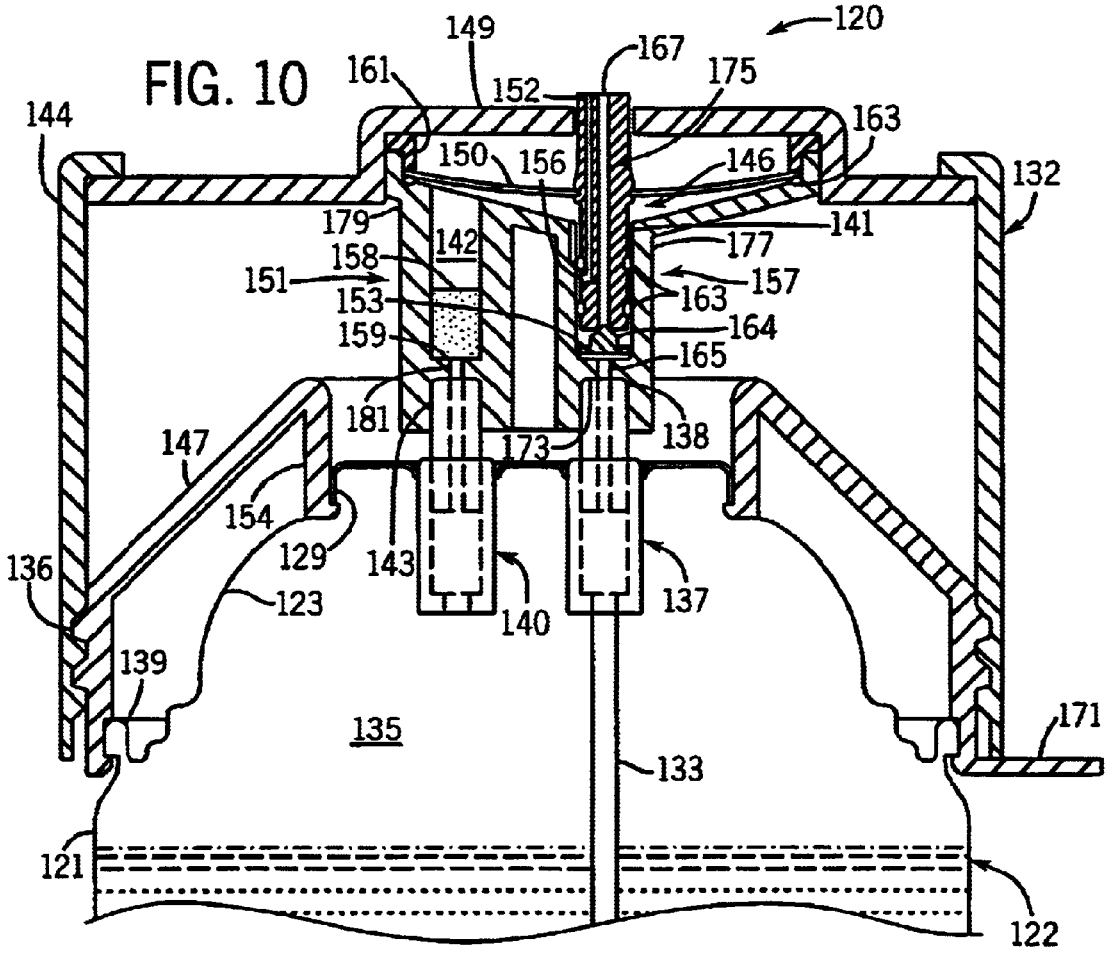
FIG. 10 is a view similar to FIG. 9, but with the valve in an "on" configuration during the accumulation phase of the dispensing cycle.

When the dispenser 120 is initially mounted onto can 122, neither conduit 138 or 143 are actuated. However, referring now to FIG. 10, once the dispenser 120 is rotated to the "ON" position, thereby beginning the accumulation phase, flanges 159 and 173 are translated axially upstream and depress valve stems 143 and 138, respectively. Active chemical thus travels through conduit 133, valve 137, and into conduit 165. The active is prevented, however, from flowing into conduit 175 by the seal provided by plug 164 and o-rings 163.

The propellant travels through valve 140, channel 181, porous media 158, conduit 142, and into accumulation chamber 146. Once the pressure of propellant acting on the axially inner surface of diaphragm 150 exceeds a predetermined threshold, the diaphragm becomes deformed from the normal closed position illustrated in FIG. 9 to the open position illustrated in FIG. 12.

This initiates a spray phase, during which the diaphragm 150 causes wall 141 to become displaced axially upstream, thereby removing the inlet to channel 175 from the plug 164. Accordingly, active chemical flows along the direction of arrow N from conduit 138, through channel 153, and into conduit 175 where it exits the dispenser 120 at outlet 167. Additionally, when wall 141 is displaced, the outer o-ring is removed from the inner surface of wall 141.

As a result, propellant travels from accumulation chamber 164 through the gap formed between the radially inner surface of wall 177 and the radially outer surface of wall 141 along the direction of arrow O, through channel 156, and into channel 152 where it exits the dispenser as a separate stream. Once the pressure within accumulation chamber 146 abates, the diaphragm snaps back to the closed position to begin a subsequent accumulation phase.

Figure 13:
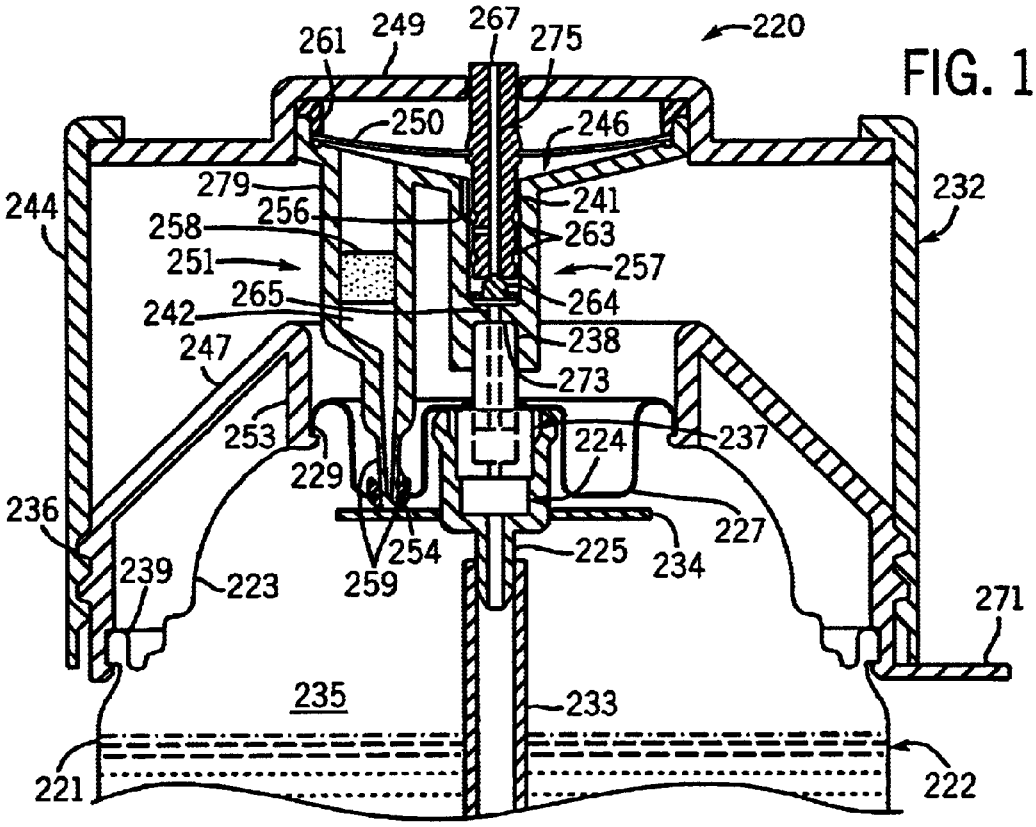
FIG. 13 is a sectional view of an automatic dispensing valve assembly of yet another embodiment in an "off" configuration.

Referring next to FIG. 13, a dispenser 220 is illustrated in accordance with another embodiment of the invention having similar construction to the last embodiment. The primary differences reside in the active valve assembly 257 and propellant valve assembly 251.

In particular, the active valve assembly 257 includes an annular lip 225 that extends axially upstream into conduit 233, and defines and interior cavity 224. The axially upstream end of lip 225 fits inside conduit 233 to deliver active to valve 237.

The propellant valve assembly 251 includes a flexible seal 234 extending radially outwardly from member 225 such that the axially outer surface of seal 234 rests against the axially inner surface of a seat 254. Seat 254 is disposed within the cup 234, and receives inner and outer fork members 259 therein. Fork 259 defines the axially inner end of a wall 279 that encloses a conduit 242 that flows into accumulation chamber 246. A porous flow control media 258 is disposed within conduit 242.

Figure 14:
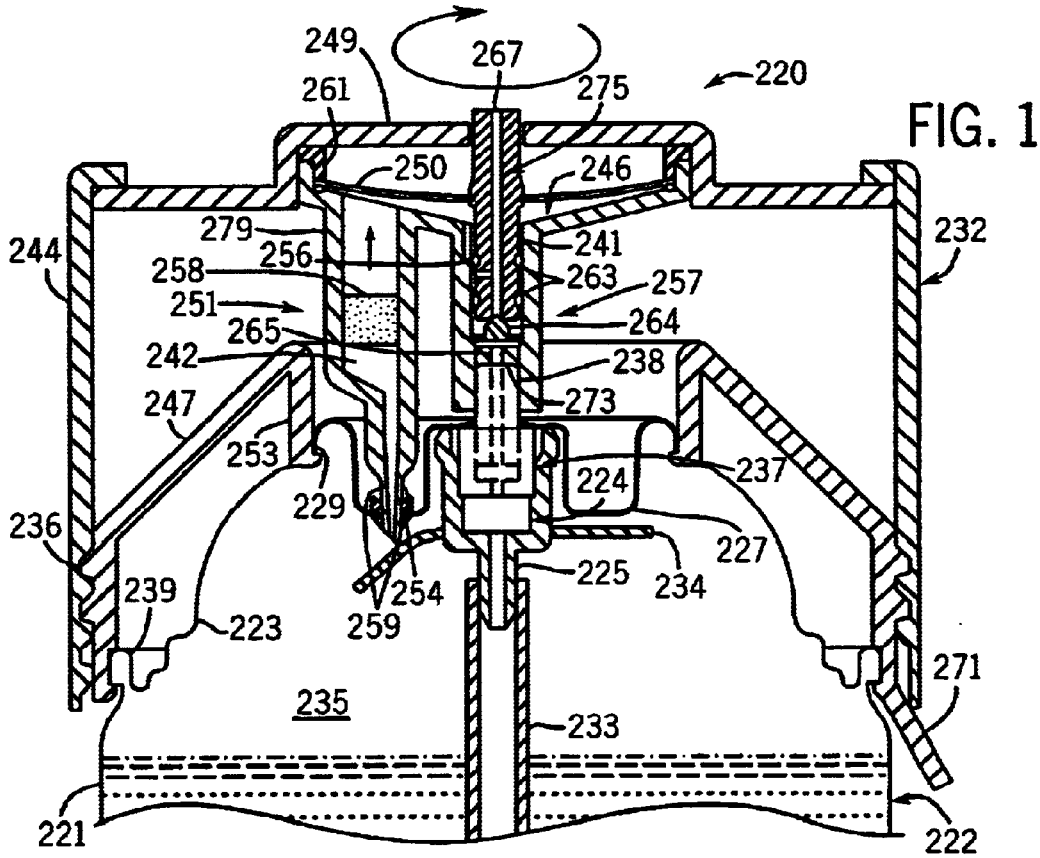
FIG. 14 is a view similar to FIG. 13, but with the valve in an "on" configuration during the accumulation phase of the dispensing cycle.

When the dispenser is in the "OFF" position illustrated in FIG. 13, seal 234 prevents propellant from entering channel 242. However, referring to FIG. 14, when assembly 232 is further rotated to switch the dispenser "ON," fork members 259 are displaced axially upstream against seal 234 which deflects outwardly away from seat 254. Because inner fork member is displaced axially downstream from outer fork member, the inlet to channel 242 is exposed to upper portion 235 of can 222, thereby enabling propellant to enter accumulation chamber 246 via conduit 242.

Figure 15:
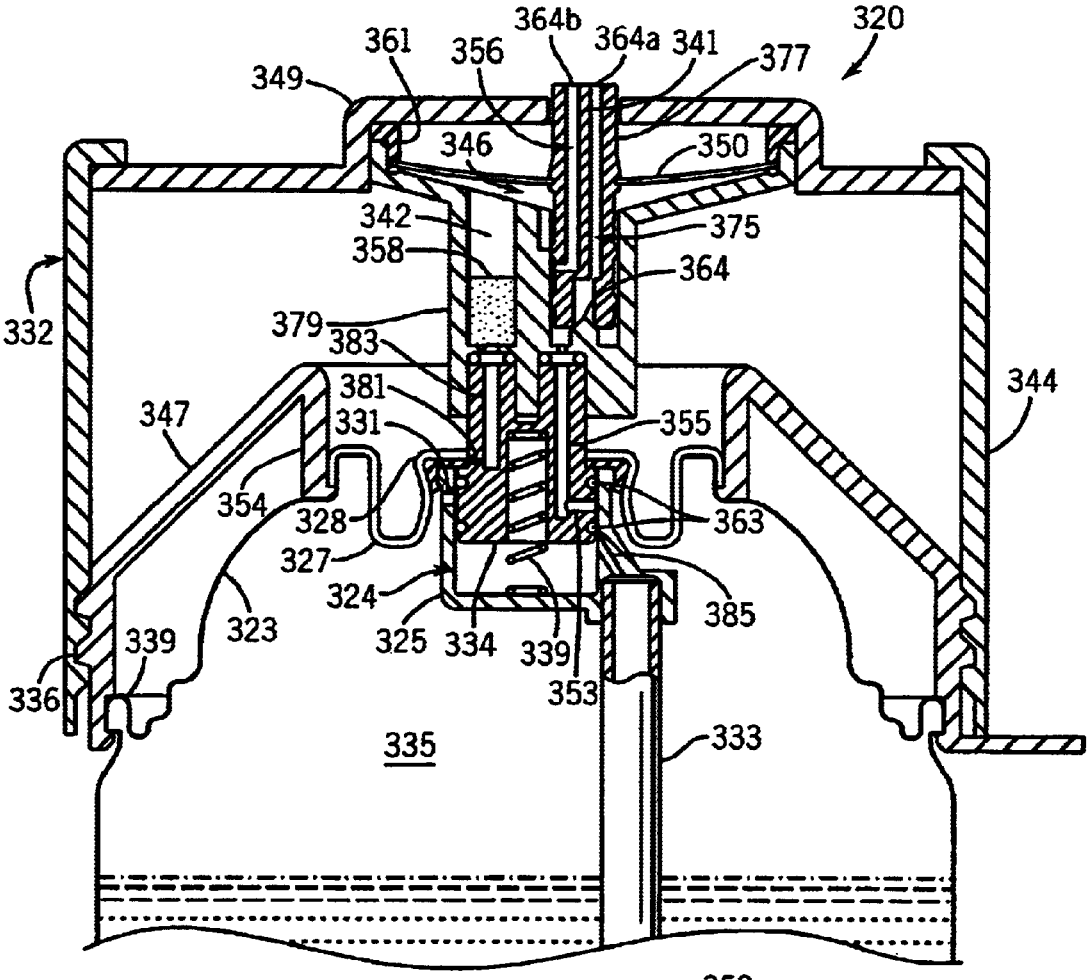
FIG. 15 is a sectional view of an automatic dispensing valve assembly of still another embodiment in an "off" configuration.
Figure 16:
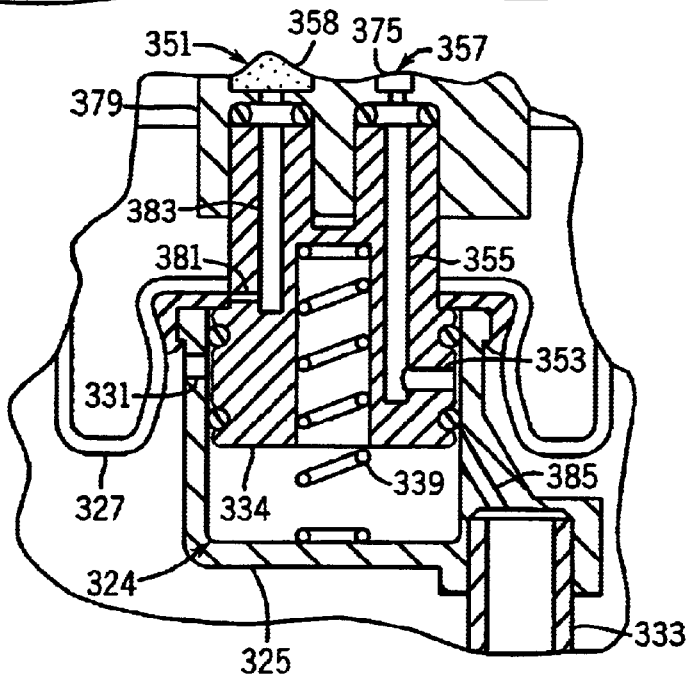
FIG. 16 is an enlarged view of a part of the valve assembly of FIG. 15.
Figure 17:
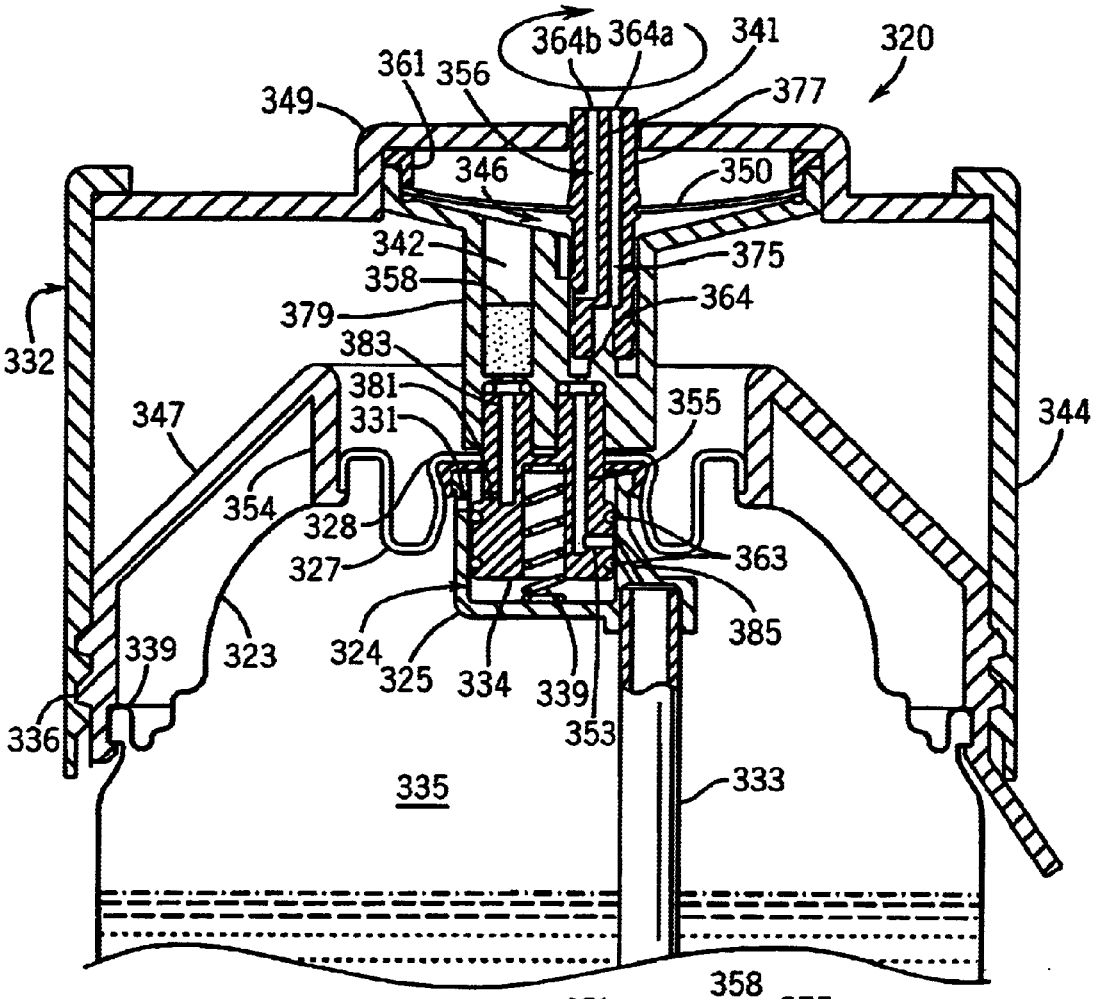
FIG. 17 is a view similar to FIG. 15, but with the valve in an "on" configuration during the accumulation phase of the dispensing cycle.
Figure 18:
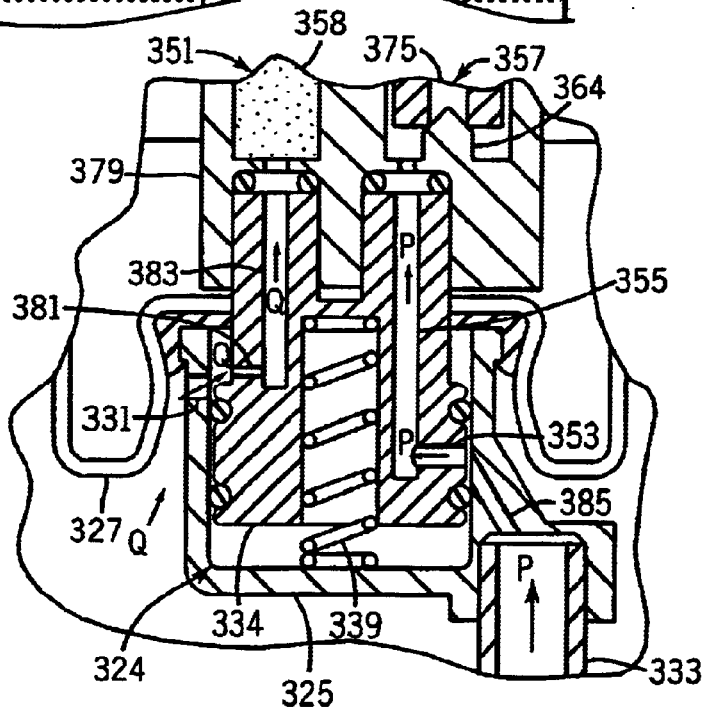
FIG. 18 is an enlarged view of a valve portion of the valve assembly of FIG. 17.
Figure 19:
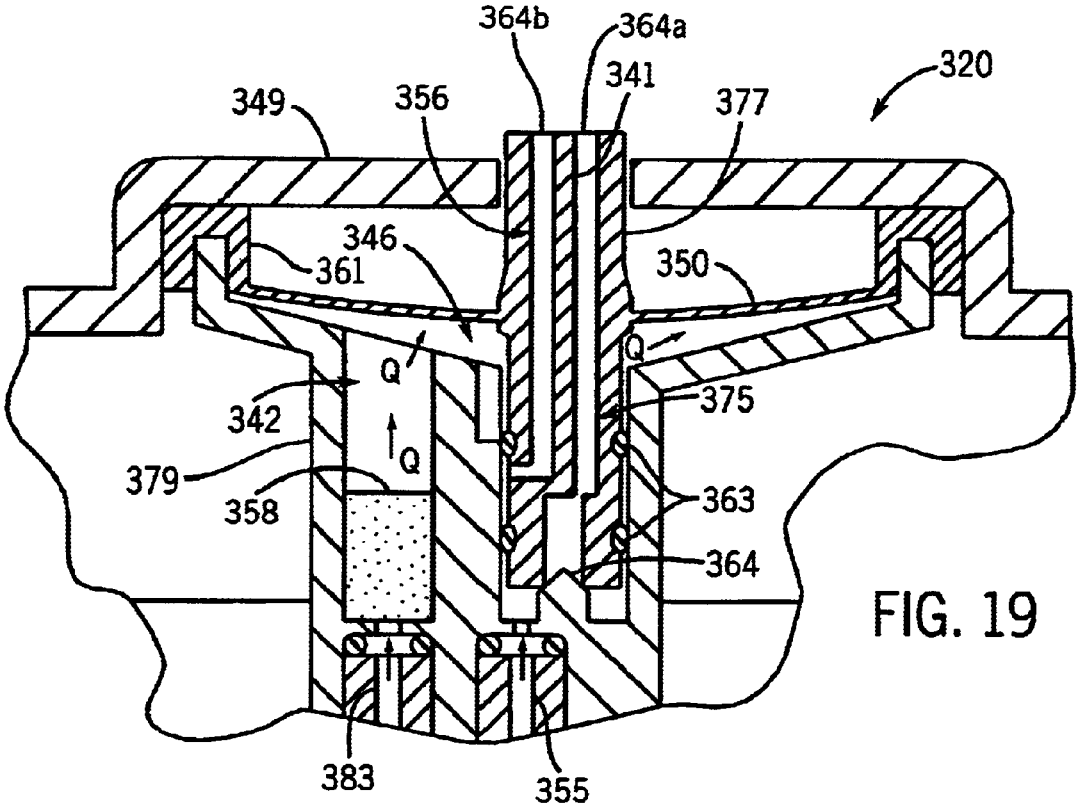
FIG. 19 is an enlarged view of the accumulation chamber portion of the valve assembly of FIG. 17.
Figure 20:
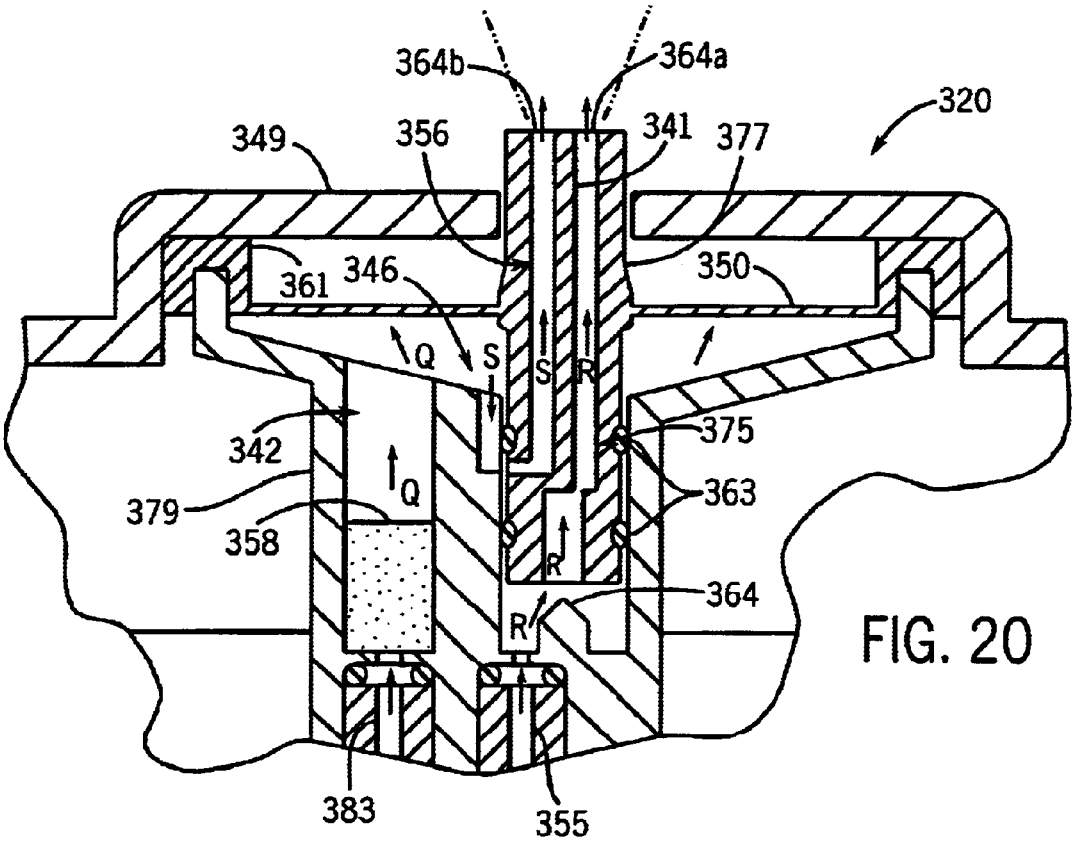
FIG. 20 is a view similar to FIG. 19, but with the valve in the spray phase of the dispensing cycle.

Referring now to FIGS. 15 and 16, a dispenser 320 in accordance with yet another embodiment is mounted onto can 322 in the same manner as described above in accordance with the last embodiment. However, a spring 339 is seated within annular member that biases tee 334 axially outwardly and against the cup 327.

Tee 334 is disposed within the cavity 324. Annular member 325 defines a channel 385 that extends from conduit 333 into conduit 324. Housing 334 defines a first conduit 353 that extends partially there through in the radial direction, and terminates at an axially extending conduit 355. Conduit 355 is in fluid communication, at its axially outer end, with a conduit 375 that extends axially out the dispenser as an active chemical outlet 364*a*. Conduit 375 is defined by an axially extending annular wall 377 in combination with an axially extending separator 341. However, when the dispenser is either "OFF" or in the accumulation phase, a plug 364 blocks the entrance into conduit 375. Furthermore, when the dispenser 320 is in the "OFF" position, conduits 385 and 353 are not in radial alignment.

Annular member 325 further defines a propellant intake channel 331 extending radially there through and in fluid communication with upper region 335 of can 322. Tee 334 defines a channel 381 extending partially there through in the radial direction, and terminates at the axially upstream end of an axially extending conduit 383. Conduit 383, at its axially outer end, is in fluid communication with a conduit 342 that opens into accumulation chamber 346. A porous media 358 is disposed in conduit 342 to regulate the flow of propellant into accumulation chamber 346. However, when the dispenser is in the "OFF" position, conduits 331 and 381 are not aligned.

An annular seal 328 is disposed around the periphery of tee 334, and positioned between wall 325 and cup 327. A pair of o-rings 363 are disposed at the radial interface between walls 325 and 334 at a position axially inwardly and outwardly of channels 353 and 331. The seal 328 and o-rings 363, in combination with the offset of the propellant and active channels, described above, prevents the flow of active and propellant into dispenser 320 when the dispenser is in the "OFF" position.

Referring now to FIGS. 17–20, when the dispenser 320 is turned "ON" by rotating the control assembly 332, the accumulation phase begins whereby tee 334 is displaced axially upstream against the force of spring 339. Accordingly, channel 353 thus becomes radially aligned with channel 385, and active chemical flows into dispenser 320 along the direction of arrow P. However, because plug 364 is blocking the entrance into channel 375, propellant is prevented from exiting the dispenser 320 during the accumulation phase.

As tee 334 is displaced, channel 381 is moved into radial alignment with channel 331, thereby enabling propellant to travel along the direction of arrow Q into and through conduit 383 and porous media 358, and into accumulation chamber 346 via channel 342. Propellant accumulates in chamber 346 until the pressure reaches a predetermined threshold, at which point the diaphragm 350 is deformed from the closed position to the open position illustrated in FIG. 20.

When the diaphragm 350 flexes axially downstream to the open position, walls 377 and 341 are also displaced axially downstream. Accordingly, the inlet to channel 375 is displaced from the plug, and active chemical is able to flow from channel 355 into channel 375 and out the active chemical outlet 364*a* as a "puff." Propellant also travels from accumulation chamber 346, through a gap formed between wall 379 and 377, into channel 366, and exits dispenser via propellant outlet 364*b* as a separate stream from the active chemical. Once pressure within the accumulation chamber 346 abates, diaphragm 350 closes to initiate another accumulation phase.

Figure 21:
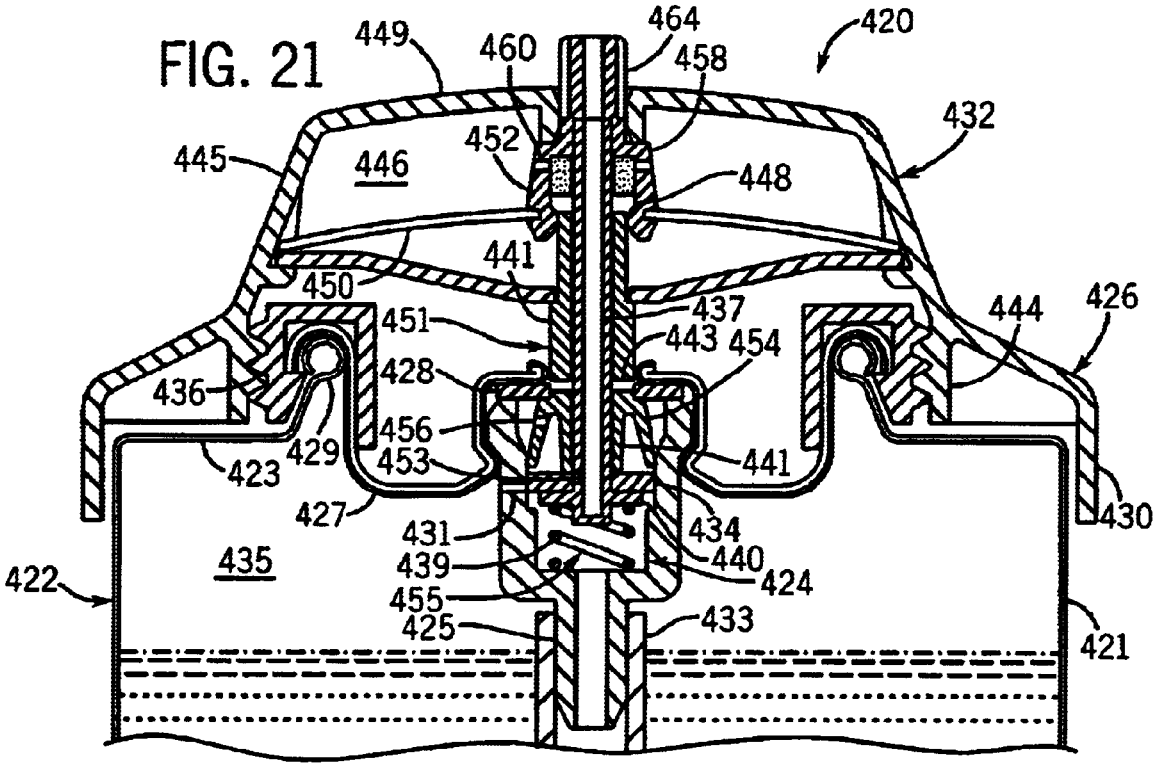
FIG. 21 is a sectional view of another embodiment of an automatic dispensing valve assembly of the present invention in an "off" configuration, mounted onto an aerosol can.
Figure 22:
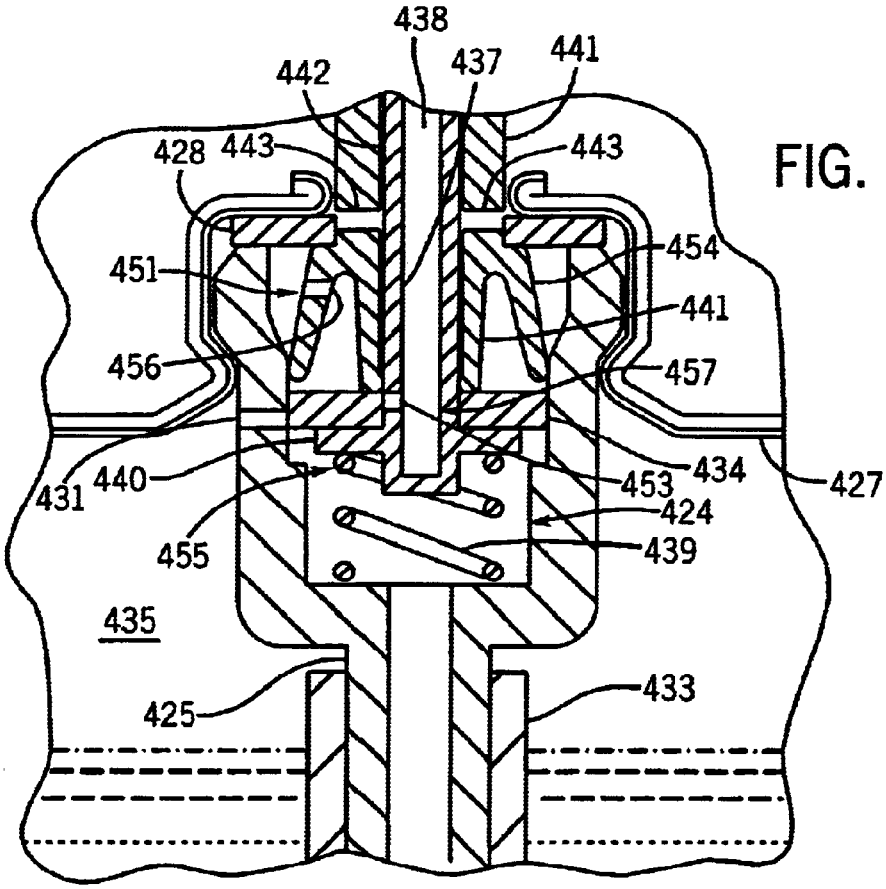
FIG. 22 is an enlarged sectional view of a part of the valve assembly of FIG. 21.

Referring next to FIGS. 21 and 22, an aerosol can 422 includes a cylindrical wall 421 that is closed at its upper margin by a dome 423. The upper margin of the can wall 421 is integrally formed with the dome 423, but could alternatively be joined at a can chime (not shown). An upwardly open cup 427 is located at the center of the dome 423 and is joined to the dome by a rim 429.

The can 422 includes an axially extending conduit 433 that is centrally disposed therein, and opens into a mixed pressurized chemical (active and gas propellant) at one end (preferably towards the bottom of the can). The upper region 435 of the can interior above the active chemical line contains pressurized gas propellant. The upper end of conduit 433 receives a tee 425 that interfaces with the interior of dispenser 420, through which the chemical may be expelled.

As will become appreciated from the description below, dispenser 420 includes a valve assembly 455 that includes a gas propellant valve assembly 451 and also an active valve assembly 457. Dispenser 420 is mostly polypropylene, albeit other suitable materials can be used.

The dispenser 420 has a lower portion 426 including an inner wall 444 and peripheral skirt 430 that are joined at their axially outer ends and form part of a control assembly 432.

The inner wall 444 and skirt 430 engage the valve cup rim 429 and outer can wall 421, respectively. In particular, rim 429 is snap-fitted within a cavity formed by a wall 436 that has threads face radially outwardly. The inner wall 444 has a radially inwardly extending threads that intermesh with threaded wall 436. The skirt fits over the outer can wall 421. In operation, the dispenser 420 may be switched "ON" and "OFF" by rotating member 432 relative to the can 422, as will be apparent from the description below.

As best seen in FIG. 22, the tee 425 defines an interior cavity 424 disposed axially downstream from conduit 433. Tee 425 is sized so as to be crimped within the open end of cup 427. An elongated annular wall 437 defines a first conduit 438 that extends axially from the interior of cavity 424 and centrally through the dispenser 420 to deliver the active mixture from the can 422 to a dispensing nozzle 464 at predetermined intervals, as will become more apparent from the description below.

Tee 425 defines a passageway 431 extending between cavity 424 and gaseous collection portion 435. A seal 434 is disposed radially inwardly and aligned with passageway 431 when the dispenser 420 is in the FIG. 22 "OFF" position. Accordingly, gas from can 422 is unable to flow into tee 425 in this orientation.

The axially outer end of tee 425 is sealed by an annular sealing member 428, which is disposed between the axially outer edge of tee 425 and axially inner edge of cup. Sealing member 428 restricts the path of the gas propellant traveling from the can 422 into the dispenser.

A second elongated annular wall 441 extends concentrically with wall 437, and has an inner diameter slightly greater than the outer diameter of wall 437. An axially extending gap 442, which provides a gas propellant intake channel, is thus formed between walls 441 and 437. Wall 441 comprises an outer portion and inner portion that are co-axial and separated to form a channel 443 extending into intake channel 442. When the dispenser is "OFF," channel 443 is radially aligned with seal 428.

A lower portion of wall 441 defines a channel 453 extending radially there through and initially aligned with seal 434. This portion further includes a radially outer leg 454 that extends axially upstream from the wall 441. Leg 454 defines a channel 456 extending radially there through that allows gas propellant to flow into the dispenser 420 when the dispenser is "ON," as will become apparent from the description below.

Upper portion of wall 441 and intake channel 442 terminate at their axially outermost ends at an inlet 448 to an accumulation chamber 446 that accepts gas propellant from can 422. A porous media 458, which is preferably made of a low porosity ceramic or any other similarly permeable material, is disposed in inlet 448 to regulate the flow rate of gas propellant entering the accumulation chamber 446. A channel 460 extends radially through the retainer wall radially between accumulation chamber 446 and porous media 458, and defines the mouth of the accumulation chamber.

Figure 26:
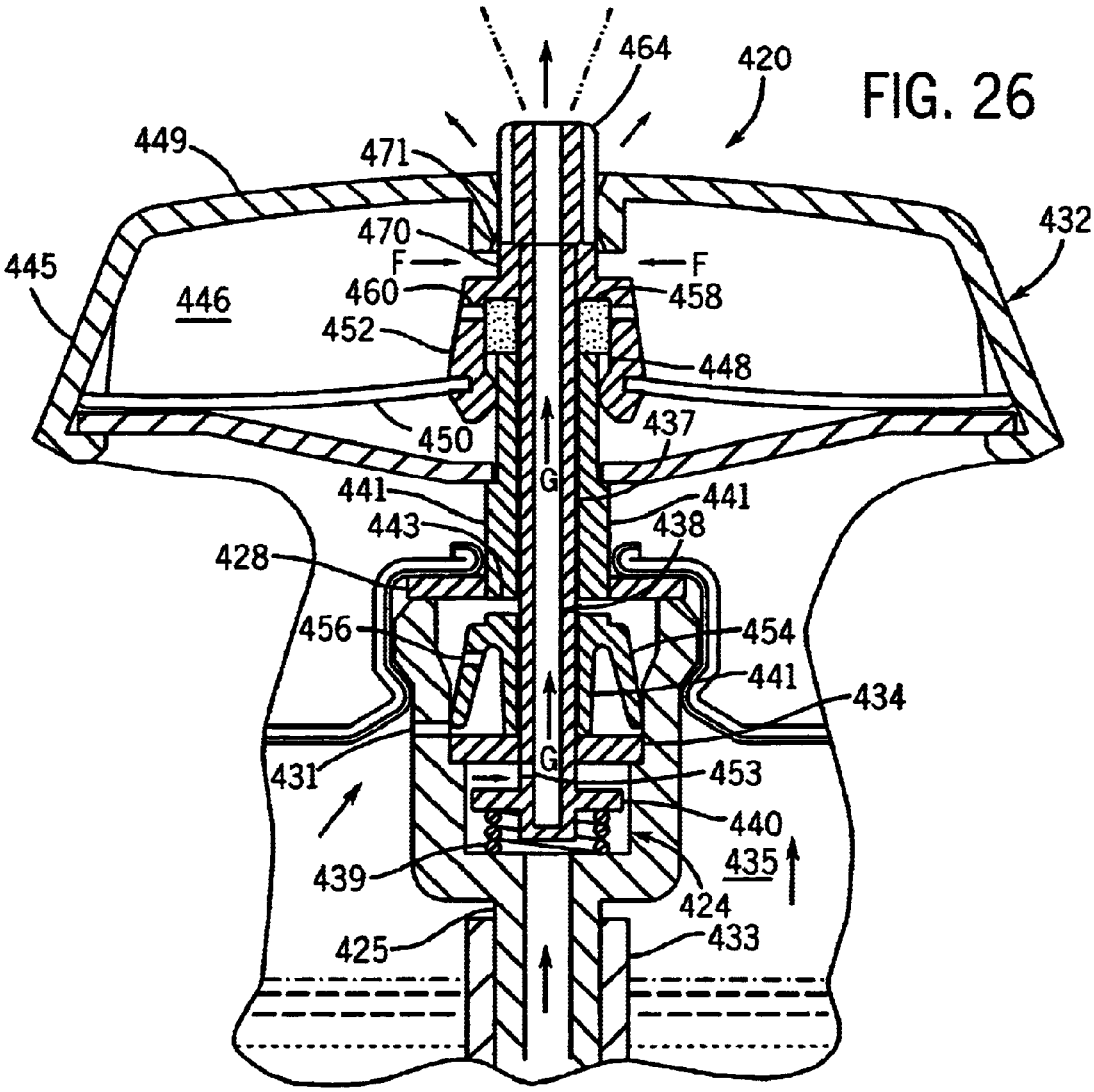
FIG. 26 is a view similar to a portion of FIG. 21, but with the valve assembly in a spray configuration.
Figure 27:
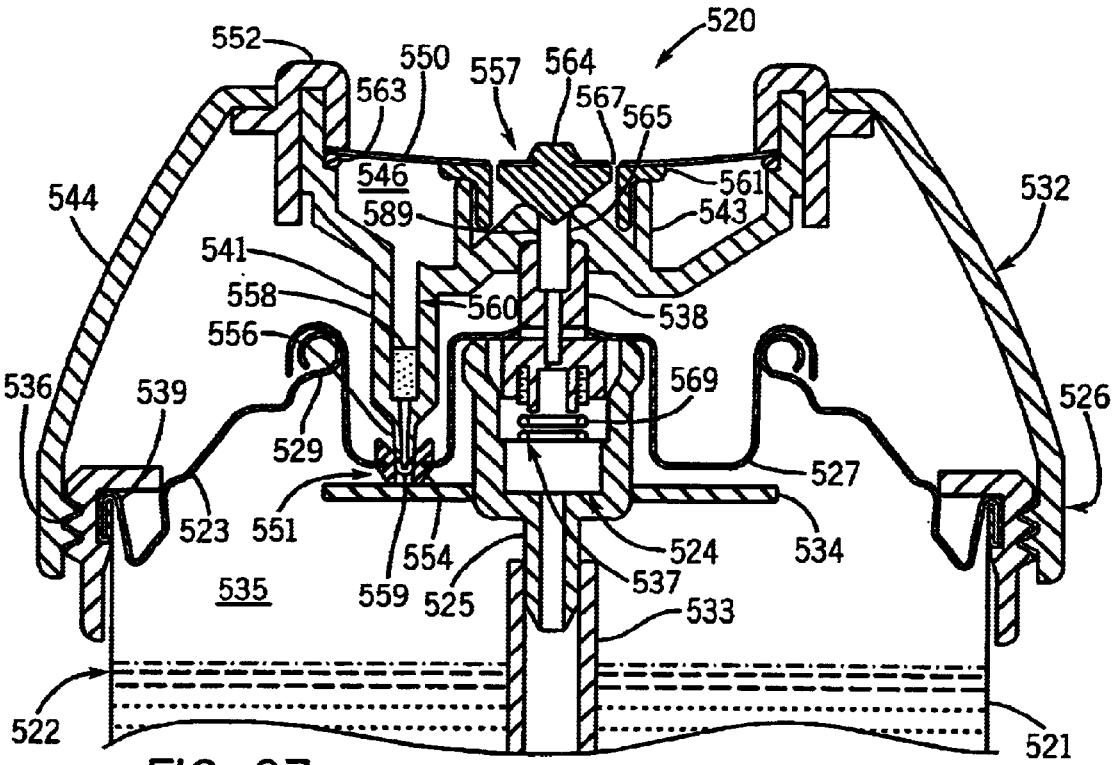
FIG. 27 is a sectional view of an automatic dispensing valve assembly of yet another embodiment in an "off" configuration.

The accumulation chamber 446 is defined at its axially outer end by a cover 449 that extends radially at the axially outermost edge of outer wall 445, which extends axially downstream from wall 444. Wall 445 further defines the radially outer edge of accumulation chamber 446. The axially inner portion of accumulation chamber 446 is defined by a flexible, mono-stable diaphragm 450 that is movable between a first closed position (FIG. 21), and a second open position (FIG. 26) to activate the dispenser 420 at predetermined intervals, as will be described in more detail below. The radially outer edge of diaphragm 450 extends into a groove formed within the radially inner surface of wall 445. The radially inner edge of diaphragm 450 is seated in a groove formed within a retainer wall 452 that is connected to wall 441.

The lower end of retainer wall 452 is sealed against the radially outer edge of wall 441 at its upper end. The radially outer surface of retainer wall 452 abuts a surface of cover 449 and is slideable there along. The upper end of retainer 452 defines dispensing nozzle 464.

A spring member 439 is disposed within cavity 424 and rests against a flange 440 that extends radially outwardly from the lower end of wall 441 to bias walls 437 and 441 (and seal 434) axially upward. When the dispenser is "OFF," the spring force is forcing the upper edge of wall 456 tightly against sealing member 428. Because channel 431 and cavity 424 are also sealed in this configuration, neither gas propellant nor active mixture is permitted to flow from the can 422 into the dispenser. The dispenser 420 is thus in a storage/shipment position.

Figure 23:
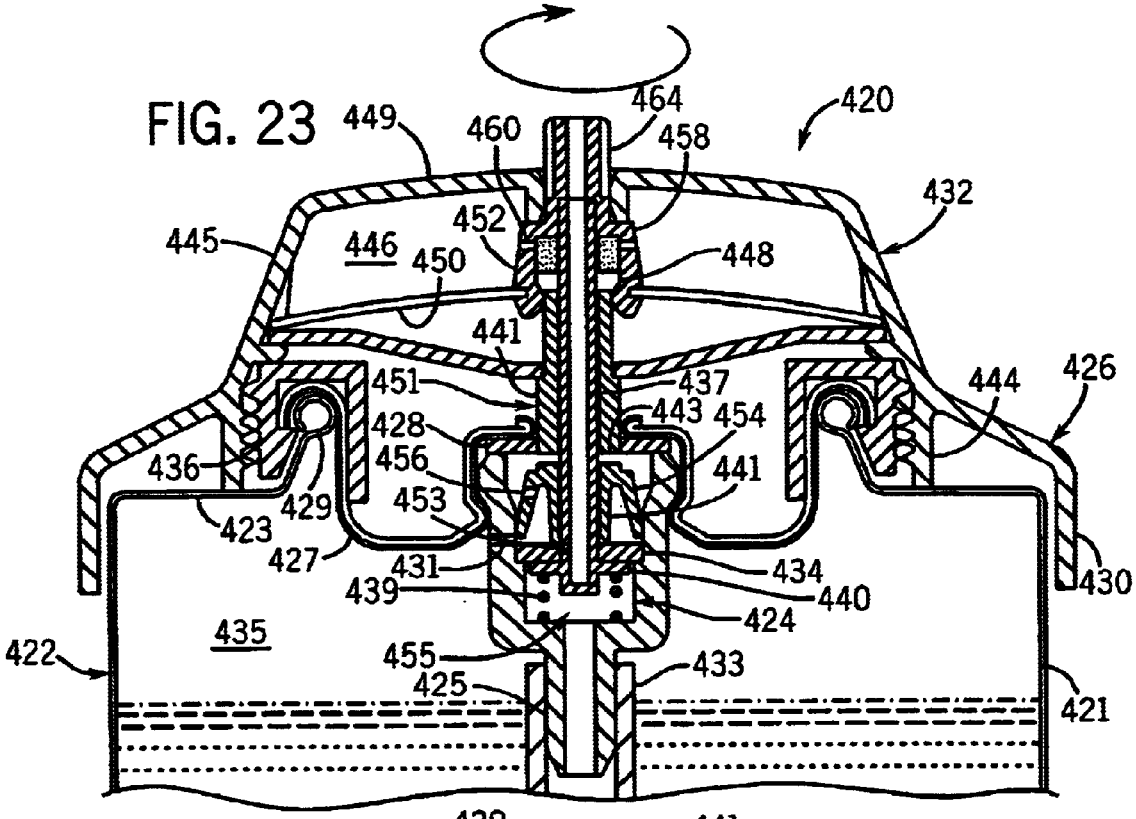
FIG. 23 is a view similar to FIG. 21, but with the valve in an "on" configuration.
Figure 24:
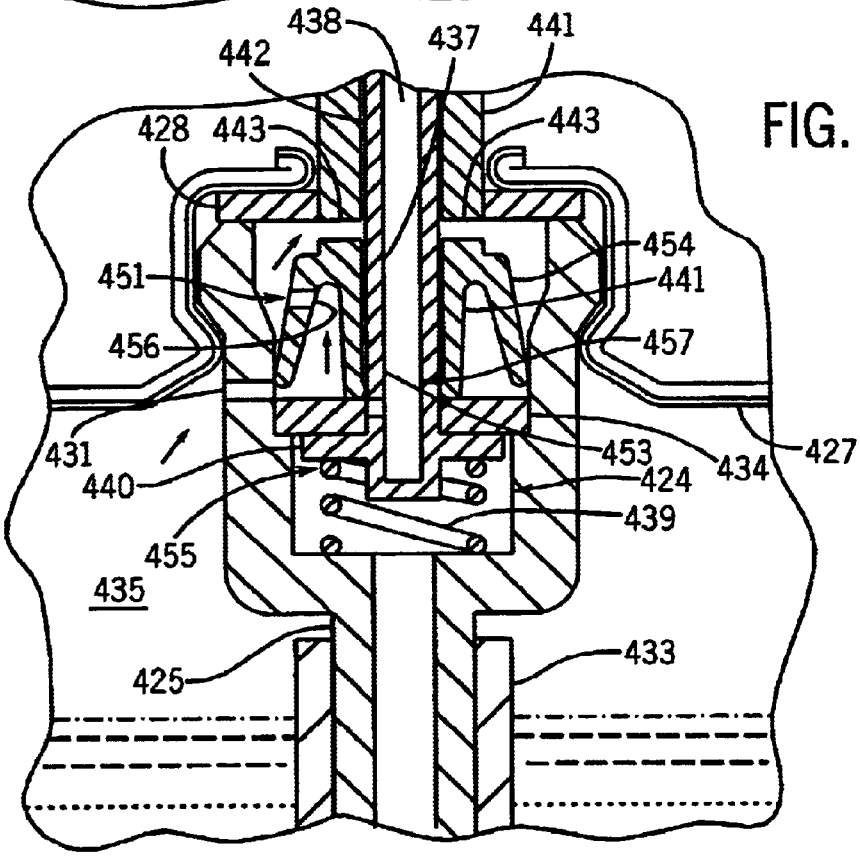
FIG. 24 is a view similar to FIG. 22 of the valve assembly of FIG. 23, with the valve in an accumulation portion of the dispensing cycle.
Figure 25:
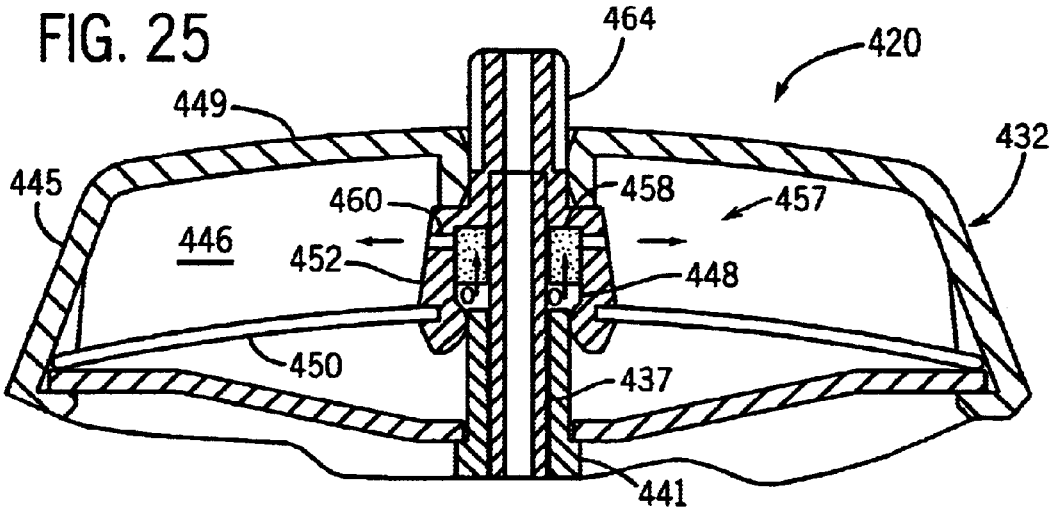
FIG. 25 is an enlarged view of the accumulation chamber of the valve assembly of FIG. 23.

Referring specifically to FIGS. 23–25, as the control assembly 432 is rotated to displace the dispenser 420 axially inwardly, wall 441 is displaced downward against the force of spring 439. The seal 434 is thus removed from alignment with channel 431, and channel 443 is axially below seal 428. An accumulation phase is thereby initiated, in which the pressurized gas propellant flows from the can 422.

Referring to FIG. 23, after the gas propellant enters cavity 424 through channel 431, it further travels upstream through channels 456 and 443 into intake channel 442. The gas propellant then travels axially downstream through channel 442 and into inlet 448 where it is regulated by porous flow control media 452 before flowing into the mouth 460 of accumulation chamber 446. Because, at this point, seal 434 remains aligned with channel 453 during the accumulation phase of the gas, the active mixture in the can 422 is unable to flow into the dispenser 420.

During the accumulation phase, the constant supply of gas propellant flowing from intake channel 442 into the accumulation chamber 446 via mouth 460 causes pressure to build therein, and such pressure acts against the upper outer surface of diaphragm 450. Once the accumulation chamber 446 is sufficiently charged with gas propellant, such that the pressure reaches a predetermined threshold, the mono-stable diaphragm 450 becomes deformed from the normal closed position illustrated in FIG. 25 to the open position illustrated in FIG. 26.

This initiates a spray phase, during which the diaphragm 450 causes retainer wall 452 and wall 437 to become displaced downward. Porous flow control media 458 also becomes displaced along with retainer wall 452. Accordingly, the amount of axial displacement is limited by the amount of axial space between flow control media 458 and the edge of wall 441. As wall 437 becomes displaced downward, channel 453 becomes axially displaced upstream from seal 434 and into cavity 424.

Accordingly, active mixture can then flow from the can 422 up into cavity 424, through channel 453 along the direction of arrow G, axially up along conduit 438, and out the nozzle 464 as a spray. The gas propellant that was stored in the accumulation chamber 446 during the accumulation cycle along with gas propellant entering into accumulation chamber 446 during the spray phase exit the dispenser past the edge 471 by which wall 470 is offset.

Because more gas propellant exits accumulation chamber 446 than the gas propellant entering, the pressure within the accumulation chamber quickly abates during the spray phase. Once the pressure within chamber 446 falls below a predetermined threshold, the diaphragm 450 snaps back to its normal closed position, re-establishing the seal between channel 453 and seal member 434, and seals off edge 471. The gas propellant continues to flow into the accumulation chamber 446 in the manner described above to initiate the next spray phase. The cycle is automatic and continuously periodic until the can contents are exhausted.

It should be appreciated that the dispenser 420 and can 422 may be sold to an end user as a pre-assembled unit. In operation, the user rotates the assembly 432 to displace the valve assembly 455 axially inwardly, thereby causing the aerosol contents to flow out of can 422, and beginning the accumulation cycle. The gas propellant flows through conduit 442 and into the accumulation chamber 446. Once the spray phase is initiated, the active mixture flows through conduit 438, and exits the nozzle 464 as a "puff" into the ambient environment. Advantageously, because no active chemical enters the accumulation chamber 446, liquid pooling within the accumulation chamber is prevented.

The duration of the accumulation phase may be controlled, for example, by adjusting the stiffness of diaphragm 450, the internal volume of chamber 446, and/or the porosity of porous flow media 458. The duration of the spray phase may be controlled, for example, by adjusting the clearance provided by channel 453 and the porosity of the accumulation chamber 446 with respect to the ambient environment, thereby controlling the depressurization time of chamber 446.

Referring next to FIGS. 27–30, a dispenser 520 is mounted onto a can 522 in accordance with a second embodiment. A more conventional container exit valve 537 extends upwardly from the center of the valve cup 527. The valve 537 has an upwardly extending valve stem 538, biased outwardly by a spring 569, through which the active mixture of the can 522 may be expelled. Valve 537 is shown as a vertically actuated valve, which can be opened by moving the valve stem 538 directly downwardly. Instead, one could use a side-tilt valve where the valve is actuated by tipping the valve stem laterally and somewhat downwardly.

Figure 28:
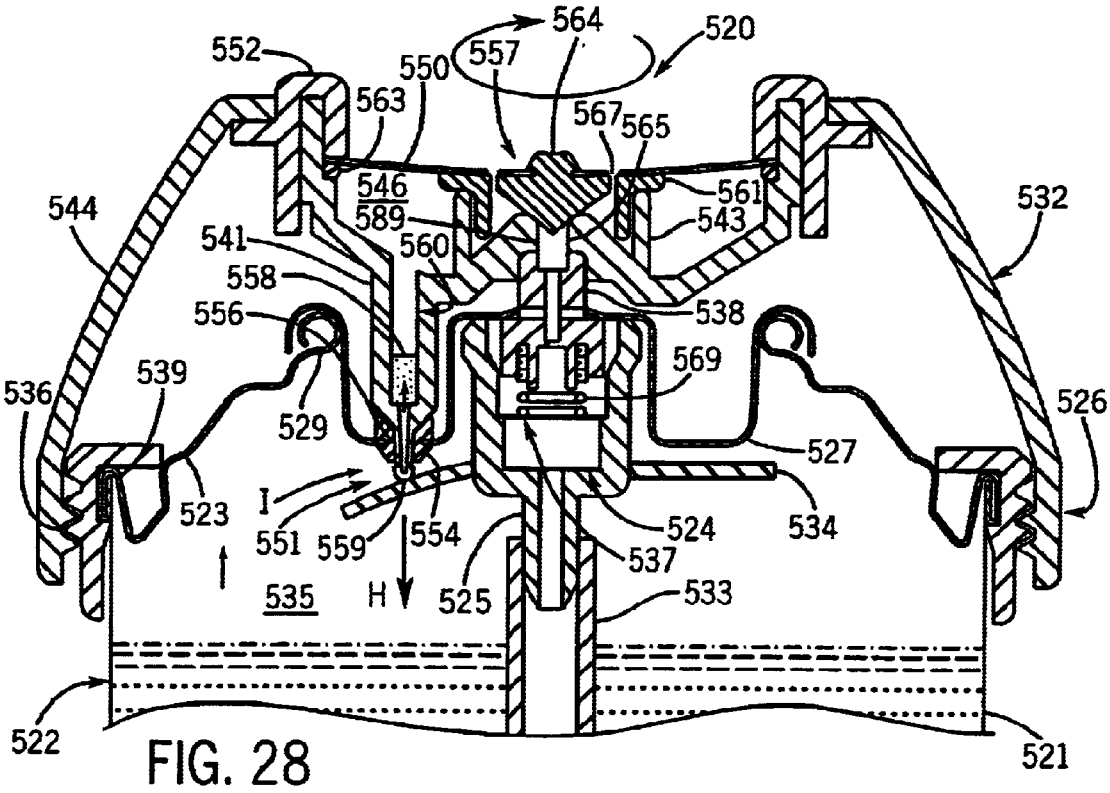
FIG. 28 is a view similar to FIG. 27, but with the valve in an "on" configuration during the accumulation phase of the dispensing cycle.
Figure 29:
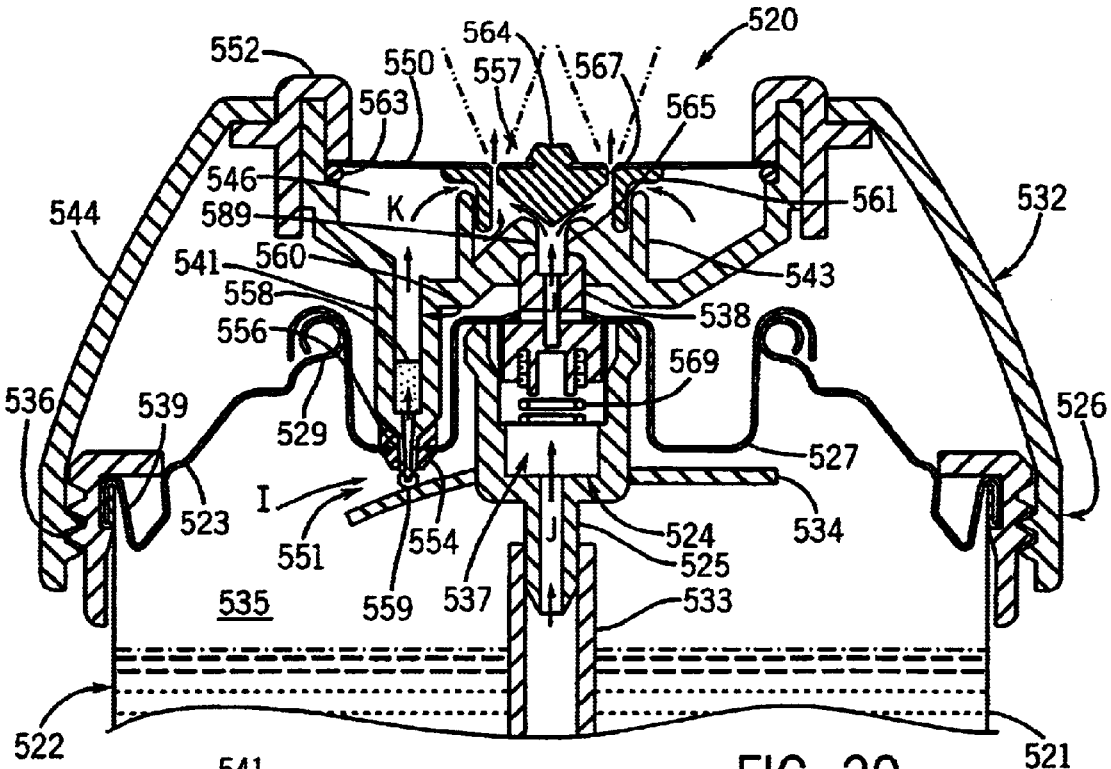
FIG. 29 is a view similar to FIG. 28, but with the valve assembly in the spray phase.

Control assembly 532 includes an outer wall 544 threaded on its inner surface that intermesh with threads of wall 536 that is connected to the can chime 539. Accordingly, the user may rotate wall 544 to switch the dispenser between the "OFF" position (FIG. 27) and the "ON" position (FIG. 28)

Wall 544 is supported at its axially outer end by wall 552 that receives, in a groove disposed at its lower end, the upper end of a retainer wall 541. An o-ring 563 is disposed at the interface between walls 552 and 541. A monostable, flexible diaphragm 550 extends radially from the interface between the o-ring 563 and wall 552. O-ring 563 thus provides a seal to prevent gas from escaping from the accumulation chamber 546 during the accumulation phase. Wall 541 further includes a flange 543 extending axially downstream towards diaphragm 550. An inverted "L" shaped wall 561 is attached to the inner surface of diaphragm 550, and receives the axially outer end of flange 543 to prevent the escape of gas propellant during the accumulation phase.

Figure 30:
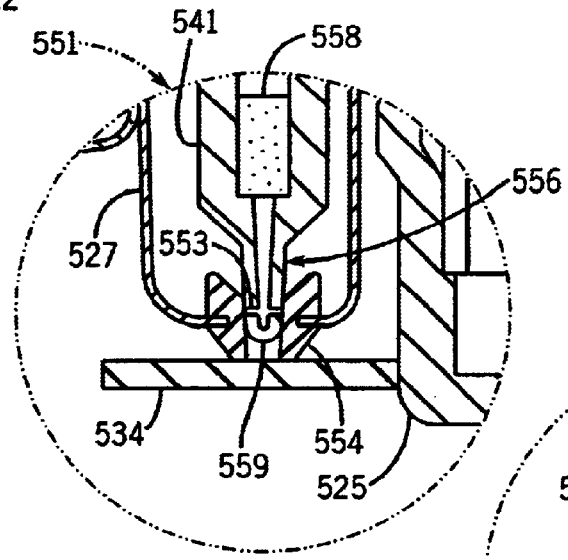
FIG. 30 is an enlarged view of a gas propellant control valve of the valve assembly illustrated in FIG. 27.
Figure 31:
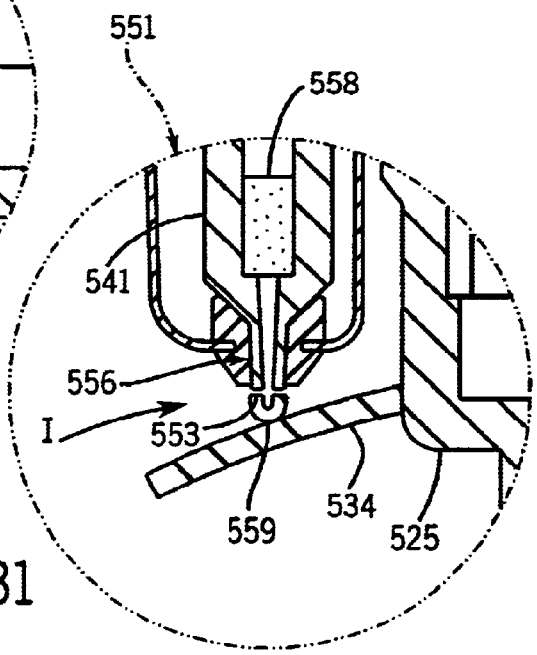
FIG. 31 is another enlarged view of the gas propellant valve of the valve assembly illustrated in FIG. 28, with the valve in a different configuration.

Referring in particular to FIG. 30, dispenser 520 also includes a gas propellant valve assembly 551 and an active valve assembly 557. The gas propellant valve assembly 551 includes wall 541, which defines a void that is occupied by a porous media 558. A plunger 556 having a tip 559 is disposed within a seat 554 axially upstream of the porous media 558. Seat 554 is affixed to the cup 527. Plunger 556 is annular, and defines a channel 553 extending there through at a location axially downstream from tip 559. Channel 535 defines the mouth of accumulation chamber 546.

A flexible seal 534 extends radially outwardly from tee 525 such that it rests against the axially inner surface of seat 554. Two seals thus prevent the gas propellant from entering accumulation chamber 546 when the dispenser is "OFF." Seal 534 minimizes leakage during filling of the can and provides a redundant seal to the plunger. Channel is in radial alignment with seat 554, thus forming a seal to prevent gas propellant from entering into the plunger.

An active valve assembly 557 (see FIG. 27) includes a hub 515 that is formed from the radially inner surface of annular retainer wall 541. The hub defines a channel 569 through which the active mixture flows from the valve stem 538 during a spray phase. A plug 564 is attached to the axially inner surface of diaphragm 550, and extends axially inwardly to seal channel 569, thus preventing active chemical from exiting the dispenser 520 during the accumulation phase. An annular opening 567 is disposed in the diaphragm 550 at a position adjacent the plug 567 to enable active chemical to flow from the hub and out the dispenser 520 during the spray phase, as will be described below.

When the control assembly 532 is rotated to switch the dispenser 520 to the "ON" position, the accumulation phase begins. In particular, wall 541 and plunger 556 are biased downwardly such that tip 559 deflects seal 534 away from the seat 554 in the direction of arrow H. The plunger 556 is depressed such that channel 553 is translated to a position axially upstream of seat 554, thereby permitting pressurized gas propellant to enter the channel 553 along the direction of arrow I.

Plug 564 is biased against hub 565, which depresses valve stem 538, thereby pressurizing active chemical against the plug. The seal formed between the plug 564 and hub 565 prevents any active chemical from exiting the dispenser during the accumulation phase.

The gas propellant travels through the porous media and into inlet 560 of the accumulation chamber 546. The constant supply of gas propellant flowing into the accumulation chamber 546 causes pressure to build therein, and such pressure acts against the inner surface of diaphragm 550. Once the accumulation chamber 546 is sufficiently charged with gas propellant, such that the pressure reaches a predetermined threshold, the mono-stable diaphragm 550 becomes deformed from the normal closed position illustrated in FIG. 28 to the open position illustrated in FIG. 29.

This initiates the spray phase, during which the diaphragm 550 is biased axially downstream, thereby also biasing plug 564 axially downstream. An outlet channel is thus formed between plug 564 and hub 565 that permits the pressurized active material to flow along the direction of arrow J out the dispenser 520 into the ambient environment as a "puff." Furthermore, wall 561 is translated axially downstream of flange 543, thereby allowing the gas propellant stored in the accumulation chamber 546 during the previous accumulation phase to travel along the direction of arrow K, mix with the active chemical, and exit the dispenser 520.

Because the channel 553 is disposed below seat 554 during the spray phase, gas propellant continues to flow into the accumulation chamber 546. However, because more propellant exits accumulation chamber 546 than the propellant entering, the pressure within the accumulation chamber quickly abates during the spray phase. Once the pressure within chamber 546 falls below a predetermined threshold, the diaphragm 550 snaps back to its normal position, re-establishing the seal between plug 564 and channel 569. The propellant continues to flow into the accumulation chamber 546 to initiate the next spray phase.

The above description has been that of preferred embodiments of the present invention. It will occur to those that practice the art, however, that many modifications may be made without departing from the spirit and scope of the invention. In order to advise the public of the various embodiments that may fall within the scope of the invention, the following claims are made.

INDUSTRIAL APPLICABILITY

The present invention provides automated dispenser assemblies for dispensing aerosol can contents without the use of repeated electric power or manual activation.

We claim:

1. A valve assembly that is suitable to dispense a chemical from an aerosol container that has a first region with a gas propellant and a second region with an active chemical, the valve assembly being of the type that can automatically iterate between an accumulation phase where the gas propellant is received from the container, and a spray phase where the active chemical is automatically dispensed at intervals, the valve assembly comprising:

a housing mountable on an aerosol container;

a movable diaphragm associated with the housing and linked to a seal, the diaphragm being biased towards a is first configuration;

an accumulation chamber inside the housing for providing variable pressure against the diaphragm;

a first passageway in the housing suitable for linking the first region of the aerosol container with the accumulation chamber;

a second passageway linking the second region with an outlet of the valve assembly;

whereby when the diaphragm is in the first configuration the seal restricts the flow of the active chemical out of the valve assembly; and whereby when the pressure of gas propellant inside the accumulation chamber exceeds a specified threshold the diaphragm can move to a second configuration where active chemical is permitted to spray from the valve assembly and where gas propellant is permitted to exhaust from the accumulation chamber, wherein the gas propellant and active chemical mix in the valve assembly prior to exiting the valve assembly.

2. The valve assembly as recited in claim 1, wherein a porous material is disposed within the first passageway to regulate the flow rate of gas propellant there through.

3. The valve assembly as recited in claim 1, wherein the diaphragm will shift back to the first configuration from the second configuration when pressure of the gas propellant in the accumulation chamber falls below a threshold amount.

4. The valve assembly as recited in claim 1, wherein the seal is displaceable in an axial direction.

5. The valve assembly as recited in claim 1, wherein the seal is spring loaded.

6. The valve assembly as recited in claim 1, further comprising a container that is linked to the valve assembly where the active chemical is at least partially in a liquid phase in the container, and an actuator portion of the housing rotates to allow gas propellant to leave the container and enter the first passageway.

7. The valve assembly as recited in claim 1, wherein the active chemical is selected from the group consisting of insect repellents, insecticides, fragrances, sanitizers, and deodorizers.

8. A method of automatically delivering an active chemical from an aerosol container to an ambient environment at predetermined intervals, the method comprising the steps of:

(a) providing a valve assembly suitable for use to dispense an active chemical from an aerosol container that has a first region with a gas propellant and a second region with an active chemical, the valve assembly being of the type that can automatically iterate without the use of electrical power between an accumulation phase where gas propellant is received from the container, and a spray phase where the active chemical is automatically dispensed at intervals, the valve assembly comprising:

(i) a housing mountable on an aerosol container;

(ii) a movable diaphragm associated with the housing and linked to a seal, the diaphragm being biased towards a first configuration;

(iii) an accumulation chamber inside the housing for providing variable pressure against the diaphragm;

(iv) a first passageway in the housing suitable for linking the first region of the aerosol container with the accumulation chamber;

(v) a second passageway linking the second region with an outlet of the valve assembly, whereby when the diaphragm is in the first configuration the seal can restrict the flow of the active chemical out of the valve assembly; and whereby when the pressure of the gas propellant inside the accumulation chamber exceeds a specified threshold the diaphragm can move to a second configuration where active chemical is permitted to spray from the valve assembly and where gas propellant is permitted to exhaust from the accumulation chamber, wherein the gas propellant and active chemical mix in the valve assembly prior to exiting the valve assembly;

(b) mounting the valve assembly to such an aerosol container; and (c) actuating the valve assembly.

* * * * *